US012235061B1

(12) United States Patent
Kohl

(10) Patent No.: US 12,235,061 B1
(45) Date of Patent: Feb. 25, 2025

(54) SMART STORE COMMUNICATION INTERFACE (SSCI) COMPATIBLE SQUIB DESIGN

(71) Applicant: BAE Systems Information and Electronic Systems Integration Inc., Nashua, NH (US)

(72) Inventor: Christopher E. Kohl, Austin, TX (US)

(73) Assignee: BAE Systems Information and Electronic Systems Integration Inc., Nashua, NH (US)

( * ) Notice: Subject to any disclaimer, the term of this patent is extended or adjusted under 35 U.S.C. 154(b) by 76 days.

(21) Appl. No.: 18/364,528

(22) Filed: Aug. 3, 2023

(51) Int. Cl.
*F41A 19/70* (2006.01)
*F42B 5/15* (2006.01)

(52) U.S. Cl.
CPC ..... *F41A 19/70* (2013.01); *F42B 5/15* (2013.01)

(58) Field of Classification Search
CPC ..... F41A 19/70; F42B 5/15
USPC ..... 102/202.14
See application file for complete search history.

(56) References Cited

U.S. PATENT DOCUMENTS

| | | | | |
|---|---|---|---|---|
| 4,313,379 | A | 2/1982 | Wallace | |
| 5,411,225 | A | 5/1995 | Lannon et al. | |
| 6,983,385 | B2 | 1/2006 | German et al. | |
| 7,091,693 | B2 | 8/2006 | Grunert et al. | |
| 7,158,843 | B2 | 1/2007 | Smith | |
| 7,278,658 | B2 | 10/2007 | Boucher et al. | |
| 7,299,427 | B2 | 11/2007 | Settles | |
| 7,343,859 | B2 | 3/2008 | Matsuda et al. | |
| 8,154,255 | B2 | 4/2012 | Wang et al. | |
| 9,003,944 | B2 | 4/2015 | Zätterqvist | |
| 9,689,928 | B2 | 6/2017 | Bernardon | |
| 9,811,079 | B2 * | 11/2017 | Theiss | H04B 17/20 |
| 9,870,333 | B1 | 1/2018 | Lam et al. | |
| 9,995,793 | B2 | 6/2018 | Bernardon | |
| 10,140,238 | B2 | 11/2018 | Mundt et al. | |
| 10,211,488 | B2 | 2/2019 | Willgert et al. | |
| 10,409,756 | B2 | 9/2019 | Zhao et al. | |
| 10,611,330 | B2 | 4/2020 | Phillion et al. | |
| 10,697,742 | B2 * | 6/2020 | Dube | F42B 5/15 |
| 2004/0064744 | A1 | 4/2004 | German et al. | |
| 2014/0242420 | A1 | 8/2014 | Schaffner et al. | |
| 2017/0327068 | A1 | 11/2017 | Phillion et al. | |
| 2019/0234718 | A1 * | 8/2019 | Dube | F42B 5/15 |

(Continued)

FOREIGN PATENT DOCUMENTS

| | | |
|---|---|---|
| GB | 2480354 | 11/2011 |
| GB | 2504632 | 2/2014 |
| GB | 2520810 | 6/2015 |

(Continued)

*Primary Examiner* — Samir Abdosh
(74) *Attorney, Agent, or Firm* — Sand, Sebolt & Wernow LPA

(57) ABSTRACT

A smart store communication interface (SSCI) squib of a countermeasure expendable. SSCI squib also includes a first electrical network. SSCI squib also includes a second electrical network that is isolated from the first electrical network. SSCI squib includes a fire pin contact that operably engages with the first electrical network and the second electrical network. The SSCI squib is configured to one of ignite a propellant loaded inside of a housing of the SSCI squib and communicate with a processor of the countermeasure expendable in response to receiving at least one electrical signal at the fire pin contact.

20 Claims, 25 Drawing Sheets

(56) References Cited

U.S. PATENT DOCUMENTS

| | | | | |
|---|---|---|---|---|
| 2021/0404783 | A1* | 12/2021 | Branch | F41A 17/06 |
| 2022/0397360 | A1* | 12/2022 | Plemons | F42B 4/26 |

FOREIGN PATENT DOCUMENTS

| | | |
|---|---|---|
| WO | 2011010163 | 1/2011 |
| WO | 2011101692 | 8/2011 |
| WO | 2021262984 | 12/2021 |
| WO | 2023014569 | 2/2023 |

* cited by examiner

SMART STORE COMMUNICATION INTERFACE (SSCI) COMPATIBLE SQUIB DESIGN

RELATED APPLICATIONS

Initially, it is noted that the present disclosure is related to the below listed U.S. Patent applications ("the Incorporated Applications"), filed on equal date herewith, the entirety of each of which is incorporated herein as if fully rewritten. The Incorporated Applications are:

1. U.S. patent application Ser. No. 18/364,508, entitled "IMPULSE CARTRIDGE CUP FOR SMART STORES COMMUNICATION INTERFACE SQUIB WITH ELECTRONICS";
2. U.S. Patent Application Ser. No. 18/364,514, entitled "COUNTERMEASURE EXPENDABLE HAVING A REMOVABLE PORT PLUG AND COUNTERMEASURE DISPENSER SYSTEM IMPLEMENTING THE SAME";
3. U.S. patent application Ser. No. 18/364,516, entitled "SMART PISTON";
4. U.S. patent application Ser. No. 18/364,522, entitled "SQUIB ENABLED HOLD UP BATTERY SWITCH"; and
5. U.S. patent application Ser. No. 18/364,527, entitled "MODULAR COMMON CONTROL CARD".

Since the present disclosure is related to the Incorporated Applications, some similar structural nomenclature is used herein when referencing some portions of the present disclosure relative to the Incorporated Applications. However, there may be some instances where structural nomenclature differs between similar elements and there may be other instances where nomenclature is similar between distinct elements relative to the present disclosure and the Incorporated Applications.

TECHNICAL FIELD

The present disclosure relates to smart technology provided inside of a countermeasure expendable for a countermeasure dispensing system (CMDS).

BACKGROUND ART

In current military technologies, military platforms, such as a military aircraft, include at least one countermeasure dispensing system (CMDS). The CMDS may eject one or more countermeasure expendables from the platform to dispense chaff material or flares away from the platform to counter a detected incoming threat, such as missiles or similar ballistic threats. Such dispensing of chaff material or flares away from the platform may then redirect the incoming threat away from the platform to leave the platform unscathed and/or unharmed. Each countermeasure dispenser in a CMDS is also electrically connected to a sequencer unit for ejecting the countermeasure expendables from the military platform. However, upon dispensing, these countermeasure expendables must dispense at suitable distances away from the military platform to ensure the incoming threat does not damage or destroy the military platform upon detonation of the incoming threat.

To combat these issues, conventional countermeasure expendables may include various technologies to ensure the countermeasure materials are dispensed at suitable distances away from the military platform to ensure the incoming threat does not damage or destroy the military platform upon detonation of the incoming threat. However, such countermeasure expendables use archaic and/or mechanical time delay devices (i.e., fuses and other similar time delays of the like) to ensure the countermeasure materials are dispensed at suitable distances away from the military platform. With such technology, testing and/or updating these countermeasure expendables may require extensive field testing that results in extensive labor and experimental costs.

SUMMARY OF THE INVENTION

In one aspect, an exemplary embodiment of the present disclosure may provide a smart store communication interface (SSCI) squib of a countermeasure expendable. SSCI squib includes a first electrical network. SSCI squib also includes a second electrical network that is isolated from the first electrical network. SSCI squib also includes a fire pin contact that operably engages with the first electrical network and the second electrical network. The SSCI squib is configured to one of ignite a propellant loaded inside of a housing of the SSCI squib and communicate with a processor of the countermeasure expendable in response to receiving at least one electrical signal at the fire pin contact.

This exemplary embodiment or another exemplary embodiment may further include that the first electrical network is configured to ignite the propellant loaded inside of the housing in response to receiving the at least one electrical signal at a first voltage at the fire pin contact; and wherein the second electrical network is configured to communicate with the processor of the countermeasure expendable in response to receiving at least another electrical signal at a second voltage at the fire pin contact that is less than the first voltage of the at least one electrical signal. This exemplary embodiment or another exemplary embodiment may further include that the support member comprises: an annular conductor of a support member operably engaged with the housing; and an insulated seal of the support member operably engaged inside of the annular conductor; wherein the insulated seal is configured to electrically isolate the first electrical network and the second electrical network from one another. This exemplary embodiment or another exemplary embodiment may further include that the insulated seal comprises: a top end; a bottom end vertically opposite to the top end; a first opening defined between the top end and the bottom end for enabling a conductor pin of the first electrical network to operably engaged with the insulated seal; and a second opening defined between the top end and the bottom end for enabling a conduit of the support member to operably engaged with the insulated seal. This exemplary embodiment or another exemplary embodiment may further include that the first electrical network comprises: a conductor pin operably engaged with the fire pin contact; a bridge wire operably engaged with the conductor pin; and a Zener diode operably engaged with and axially aligned with the fire pin contact and the conductor pin and defining a predetermined voltage threshold. This exemplary embodiment or another exemplary embodiment may further include that the second electrical network comprises: a communication wire operably engaged with the fire pin contact and electrically isolated from the conductor pin and the bridge wire. This exemplary embodiment or another exemplary embodiment may further include that when an electrical signal includes a voltage that is greater than the predetermined voltage threshold of the Zener diode, the electrical signal passes through the Zener diode to the conductor pin and the bridge wire. This exemplary embodiment or another exemplary embodiment may further include that when an electrical signal includes a voltage that is less than the predetermined voltage threshold of the Zener diode, the electrical signal passes through the communication wire and communicates with the processor of the countermeasure expendable. This exemplary embodiment or another exemplary embodiment may further include that the support member further comprises: a conduit operably engaged with the insulated seal; wherein the conduit houses a portion of the communication wire to electrically isolate the communication wire from the conductor pin and the bridge wire inside of the support member. This exemplary embodiment or another exemplary embodiment may further include that the second electrical network further comprises: an annular interface operably engaged with the communication wire and positioned external to a main passageway of the housing; wherein the annular interface contacts a first electrical connector of a set of electrical connectors of an impulse cartridge cup to enable communication between the SSCI squib and the processor of the countermeasure expendable. This exemplary embodiment or another exemplary embodiment may further include that the annular conductor comprises: an outer conductive surface operably engaged with an interior surface of the housing inside of the main passageway; and an inner conductive surface operably engaged with the insulated seal and facing away from the outer surface; wherein the outer surface of the annular conductor and the interior surface complete an electrical circuit between the first electrical network and the housing. This exemplary embodiment or another exemplary embodiment may further include that the housing further comprises: an exterior wall; an interior wall facing opposite to the exterior wall and defining the main passageway; wherein the interior wall operably engages with the outer conductive surface of the annular conductor; wherein the exterior wall contacts a second electrical connector and a third electrical connector of the set of electrical connectors of the impulse cartridge cup to transmit electrical power to a payload of the countermeasure expendable. This exemplary embodiment or another exemplary embodiment may further include an insulator operably engaged with the fire pin contact, the first electrical network, and the second electrical network; wherein the insulator is configured to direct an electrical signal between the first electrical network and the second electrical network when received at the fire pin contact. This exemplary embodiment or another exemplary embodiment may further include an electronic circuit board operably engaged with the fire pin contact; and at least one transient voltage suppressor (TVS) operably engaged with the electronic circuit board; wherein the at least one TVS is configured to suppress at least one transient received at the fire pin contact.

In another aspect, an exemplary embodiment of the present disclosure may provide a method. The method comprises steps of: providing a canister adapted to retain a countermeasure payload therein, wherein the canister has a first end and a second end, wherein the countermeasure payload is to be configured to deployed from the first end; providing a smart store communication interface (SSCI) squib of a countermeasure expendable, the SSCI squib comprises: a first electrical network; a second electrical network isolated from the first electrical network; and a fire pin contact operably engaged with the first electrical network and the second electrical network; effecting the SSCI squib to loaded into an impulse cartridge (IC) cup at the second end of the canister; effecting the SSCI squib to loaded into an impulse cartridge (IC) cup at the second end of the canister; and performing one of the following steps in response to receiving at least one electrical signal at the fire pin contact: effecting the first electrical network to ignite a propellant of the SSCI squib; or effecting the second electrical network to communicate with a processor of the countermeasure expendable.

This exemplary embodiment or another exemplary embodiment may further include that the step of effecting the SSCI squib to loaded into the IC cup further comprises: effecting an annular interface of the SSCI squib to a first electrical connector of a set of electrical connectors of the IC cup; and communicating with the processor of the countermeasure payload via the first electrical connector. This exemplary embodiment or another exemplary embodiment may further include that the step of effecting the second electrical network to communicate with the processor of the countermeasure expendable further comprises: effecting the at least one electrical signal having a first voltage to be sent to the fire pin contact; outputting the at least one electrical signal from the fire pin contact to a Zener diode of the first electrical network; and sending the at least one electrical signal to a communication wire of the second electrical network, wherein the first voltage of the at least one electrical signal is less than a predetermined voltage threshold of the Zener diode. This exemplary embodiment or another exemplary embodiment may further include that the step of effecting the SSCI squib to loaded into the IC cup further comprises: effecting a housing of the SSCI squib to contact a first electrical connector of the set of electrical connectors of the IC cup; effecting the housing of the SSCI squib to contact a second electrical connector of the set of electrical connectors of the IC cup; and enabling power of the processor of the countermeasure payload, via the first electrical connector and the second electrical connector, in response to the at least one electrical signal. This exemplary embodiment or another exemplary embodiment may further include that the step of effecting the first electrical network to ignite the propellant of the SSCI squib: effecting the at least one electrical signal having a second voltage to be sent to the fire pin contact; outputting the at least one electrical signal from the fire pin contact to a Zener diode of the first electrical network; and outputting the at least one electrical signal from the Zener diode to a bridge wire of the first electrical network, wherein the second voltage of the at least one electrical signal is greater than a predetermined voltage threshold of the Zener diode. This exemplary embodiment or another exemplary embodiment may further include suppressing at least one transient, via at least one transient voltage suppressor, at the fire pin contact.

BRIEF DESCRIPTION OF THE DRAWINGS

Sample embodiments of the present disclosure are set forth in the following description, are shown in the drawings and are particularly and distinctly pointed out and set forth in the appended claims.

Similar numbers refer to similar parts throughout the drawings.

DETAILED DESCRIPTION

Figure 1:
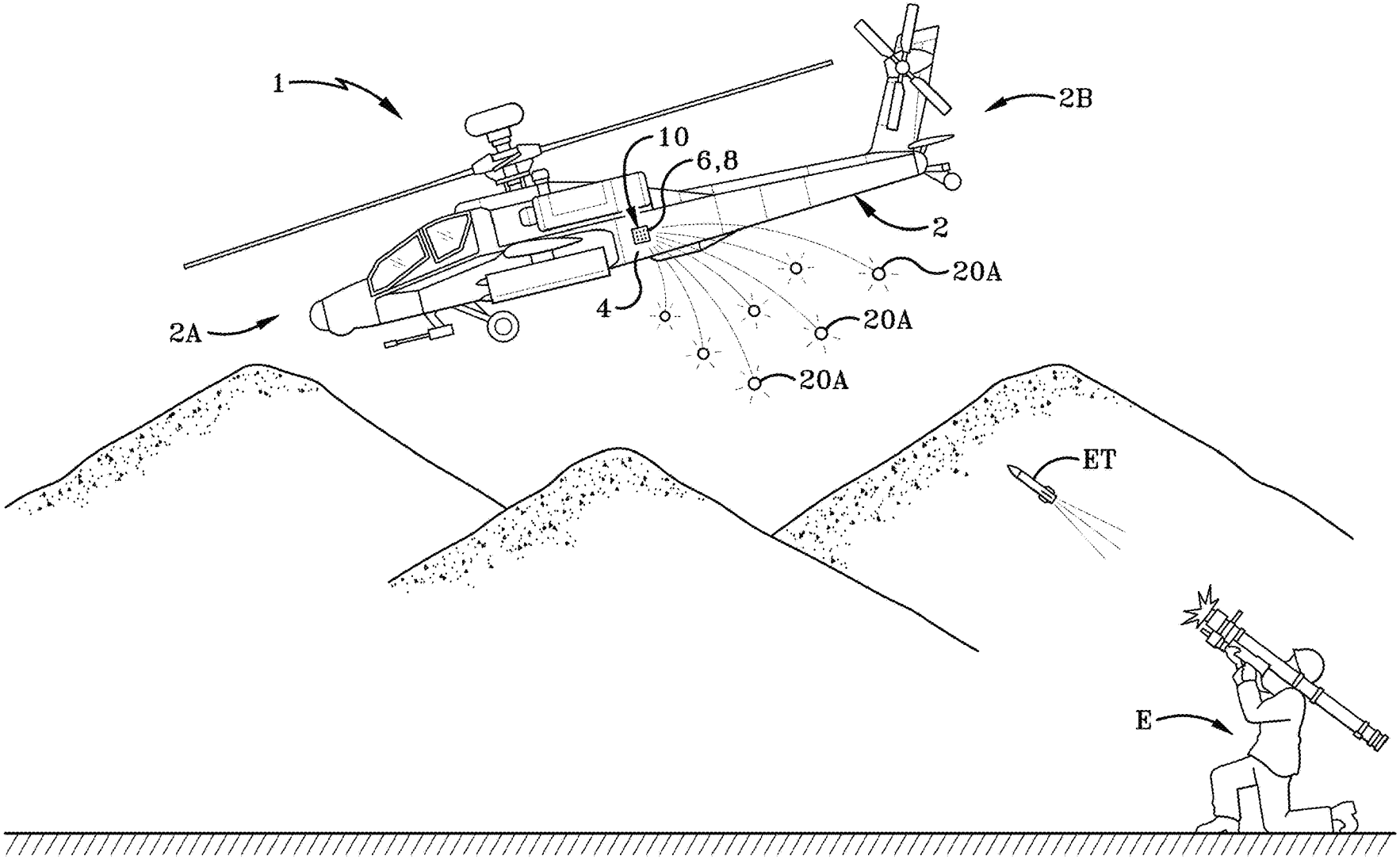
FIG. 1 (FIG. 1) is a diagrammatic view showing a platform having a CMDS, wherein CMDS is being used to deter an incoming enemy threat via countermeasure material.

FIG. 1 illustrates a platform 1 such as a vehicle, ship or aircraft, which may be manned or unmanned, that includes a main body 2. As used herein, aircraft refers to fixed or rotary wing aircraft as well as unmanned aerial vehicles (UAVs) and satellites. The main body 2 has a front end 2A and a rear end 2B longitudinally opposite to the front end 2A. It should be understood that the directions of "front," "rear," "top," "bottom," "right," and "left" are only used as a directional reference for the main body 2 and its associated components and/or parts described herein and illustrated in FIG. 1.

The platform 1 in this example is an aircraft and includes a sidewall 4 that extends longitudinally between the front end 2A of the main body 2 and the rear end 2B of the main body 2. The sidewall 4 defines an opening 6 that is disposed between the front and rear ends 2A, 2B of the main body 2 providing access to a chamber 8. The opening 6 and the chamber 8 defined by the sidewall 4 is sized and configured to receive a countermeasure dispensing system (hereinafter "CMDS") generally referred to as 10. CMDS 10 operably engages the sidewall 4 of the main body 2 to mechanically fix the CMDS 10 with the platform 1. As illustrated in FIG. 1, the CMDS 10 is in line with the sidewall 4 of the main body 2 such that the CMDS 10 is even or conformal with the mold line of the platform 1 for aerodynamic purposes. Upon mounting the CMDS 10, the CMDS 10 is electrically connected to a legacy wiring harness 12B that is provided in the platform 1 to provide power and communication to some or all electrical components in the CMDS 10, which is described in more detail below.

Prior to military operation or an aerial mission of the platform 1, the CMDS is pre-loaded with a set of countermeasure expendables 20. Each countermeasure expendable of the set of countermeasure expendables 20 is loaded with flare and/or chaff material 20A for countermeasure purposes. Expendables 20 may also include other countermeasure materials other than a flare or chaff. In addition, each countermeasure expendable of the set of countermeasure expendables 20 includes an impulse cartridge or squib for detonating and dispensing the countermeasure material 20A from the platform 1. During military operation, the countermeasure material 20A (e.g., flare and/or chaff material or other material) provides a distraction to an incoming enemy threat "ET", initiated by an enemy "E", where the incoming enemy threat "ET" is diverted to the flare and/or chaff material 20A while allowing the platform 1 to remain unscathed. During the military operation or the aerial mission, the platform 1 may receive a warning from an on-board electronic warfare (EW) system regarding the incoming enemy threat "ET" approaching the platform 1. Upon a determination made by the on-board EW system and/or an operator, the CMDS 10 dispenses a calculated amount of countermeasure expendables from the set of countermeasure expendables 20 that are disposed underneath, behind, or to the side of the platform 1. In addition, the CMDS 10 may also be provided along any suitable location of the platform 1 other than sidewall 4 of the main body 2. In one exemplary embodiment, a CMDS may be provided within a wing of an aircraft. In another exemplary embodiment, a CMDS may be provided in a fuselage or a pod disposed on an aircraft.

It should be understood that the CMDS 10 is logically powered and controlled by an on-board system. The system may include suitable devices and apparatuses that are operably engaged with one another to logically control and power the CMDSs (such as CMDS 10) described and illustrated herein. In the illustrated embodiments, CMDSs described and illustrated herein may be logically powered and controlled by a legacy on-board system retaining a majority of legacy devices and apparatuses that are operably engaged with and in communication with one another. Examples of legacy devices and apparatuses that may be provided in this system include, but not limited to, a cockpit interface, discrete components, serial buses, a programmer, and data links. In another instance, a CMDS described and illustrated herein may be logically powered and controlled by a new on-board system having new devices and apparatuses that are operably engaged with one another.

Moreover, it will be understood that the on-board system may also retain and use legacy components of legacy CMDSs currently available. In one instance, a CMDS described and illustrated herein may maintain a legacy dispenser along with a legacy wiring harness operably engaging the CMDS with the legacy on-board system. In another instance, a CMDS described and illustrated herein may only maintain a legacy wiring harness operably engaging the CMDS with the legacy on-board system. Furthermore, it will be understood that CMDSs described and illustrated herein may also use new components that are not legacy to an aircraft nor a legacy on-board system provided on the aircraft. Such use of legacy and/or new components of CMDSs are described in further details below.

Figure 2A:
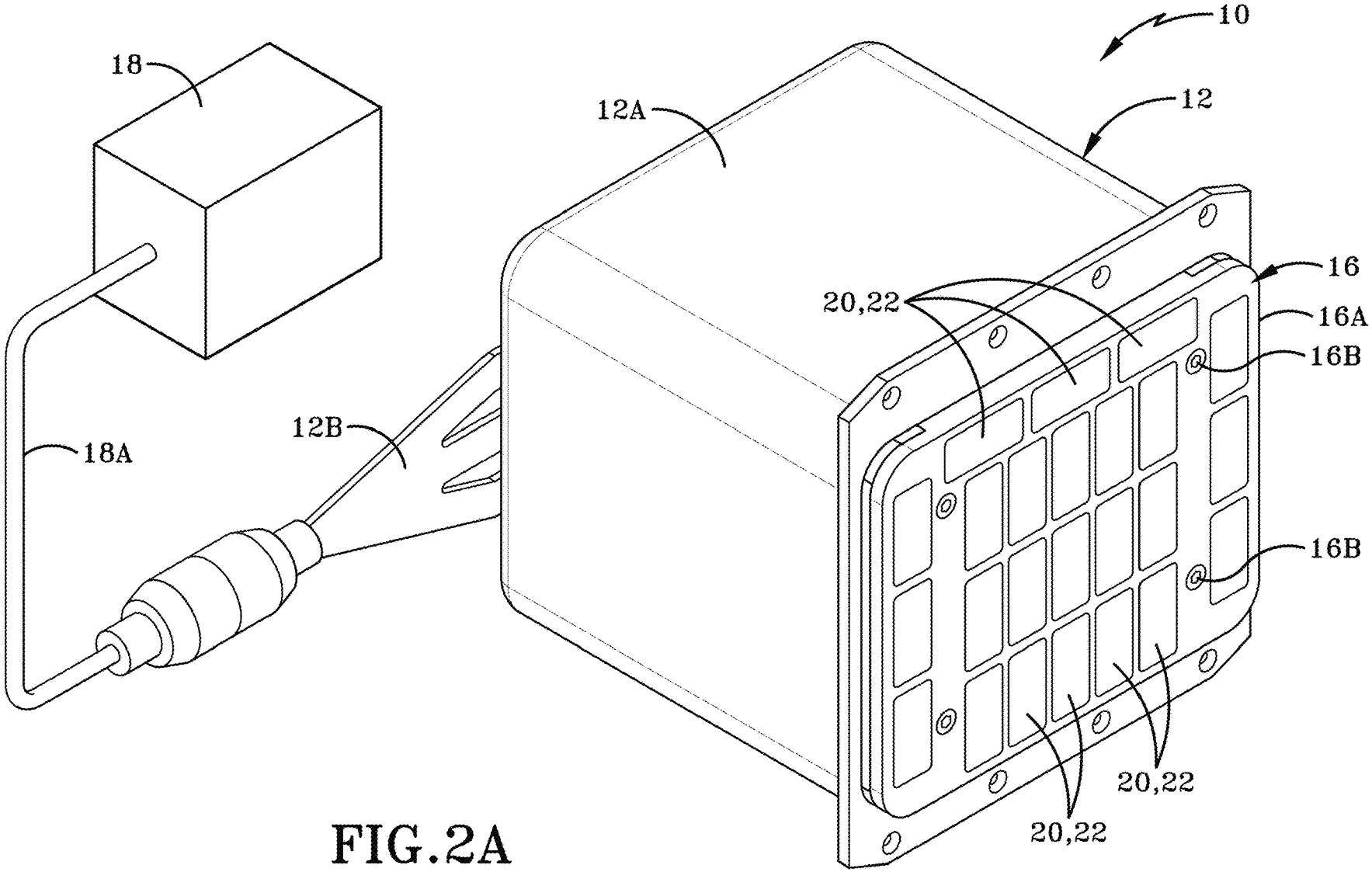
FIG. 2A (FIG. 2A) is a top, front, first side isometric perspective view of CMDS illustrated in FIG. 1, wherein CMDS is loaded with a set of countermeasure expendables.
Figure 2B:
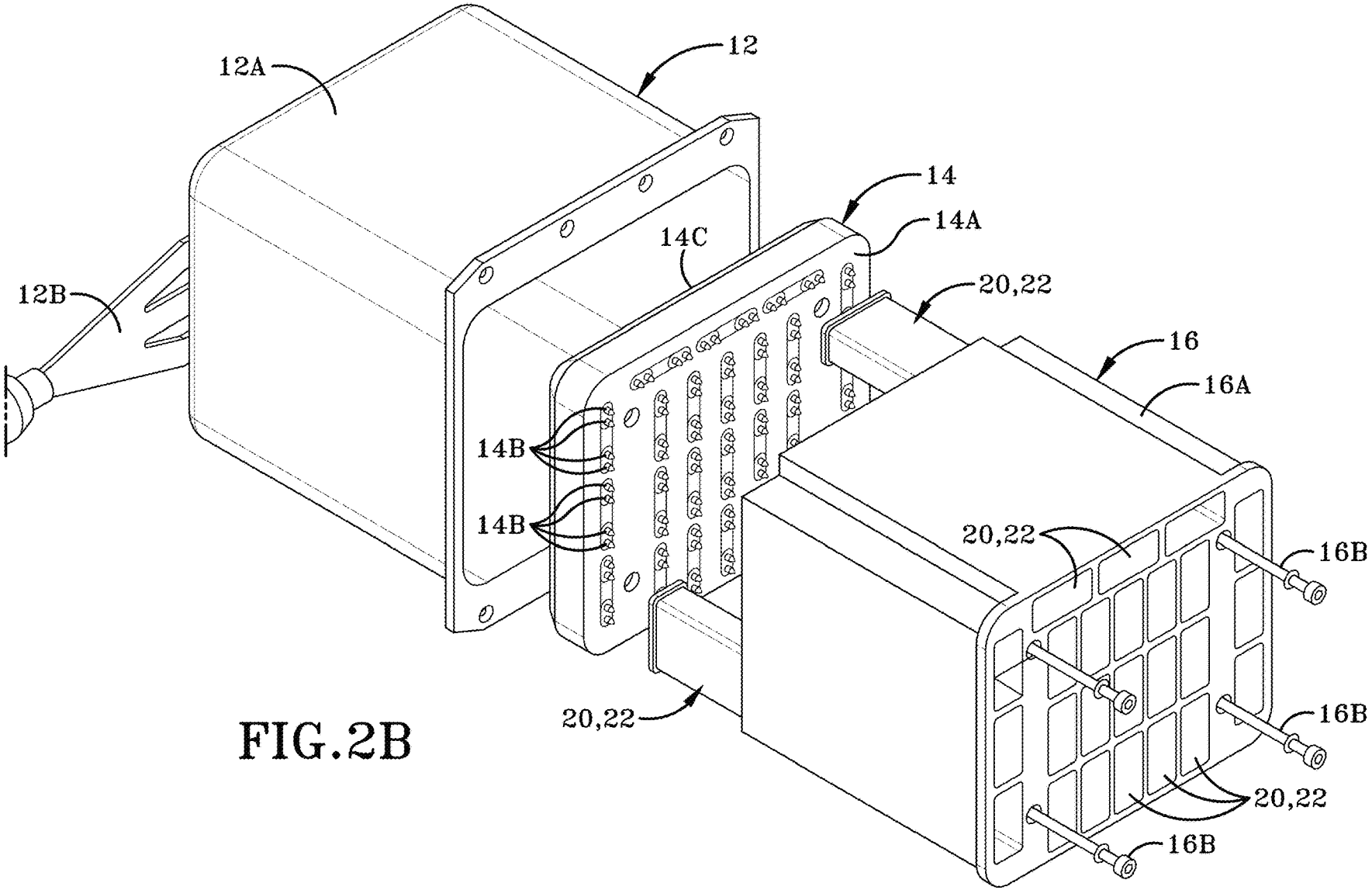
FIG. 2B (FIG. 2B) is an exploded view of the CMDS and the set of countermeasure expendables.

CMDS 10 includes a dispenser assembly 12 that operably engages with the platform 1 inside of the chamber 5 defined in the sidewall 4. As best seen in FIG. 2B, a dispenser 12A of dispenser assembly 12 is configured to hold various assemblies, components, and parts of CMDS 10 inside of the platform 1 for countermeasure operations, which are described in greater detail below. While not illustrated herein, connectors or fasteners may operably engage the dispenser assembly 12 with the platform 1, via a flange of the dispenser 12A, for maintaining the CMDS 10 with the platform 1; such engagement of the dispenser assembly 12 with the platform 1 may be conventional means currently used in the art. In other exemplary embodiments, connectors described previously may be any suitable components that are configured to operably engage a dispenser assembly with a platform for maintaining a CMDS with the platform (e.g., fasteners and other similar components of the like). In one exemplary embodiment, dispenser assembly 12 may be a legacy AN/ALE-47 dispenser used in a standard AN/ALE-47 CMDS. In another exemplary embodiment, dispenser assembly 12 may be a new dispenser assembly that is configured to be used with a new CMDS currently available on platforms discussed herein.

Dispenser assembly 12 also includes a legacy wiring harness 12B that operably engages with the dispenser 12A. Wiring harness 12B is configured to provide an electrical connection between the dispenser 12A and a sequencer of CMDS 10 provided on the platform 1 to enable logic communication between each of the dispenser 12A and the sequencer for dispensing and/or ejecting expendables from the CMDS 10. Such dispensing and ejecting of countermeasure expendables from the CMDS 10 is described in greater detail below.

Referring to FIG. 2B, CMDS 10 also includes a breechplate assembly 14 that operably engages with the dispenser assembly 12, particularly with the dispenser of the dispenser assembly 12. Upon assembly, the entire breechplate assembly 14 is housed inside of the dispenser 12A and provides forty-eight firing lines as compared to the legacy thirty fires lines provided in legacy CMDS. Such parts and components of the breechplate assembly 14 are discussed in greater detail below.

Breechplate assembly 14 includes a faceplate 14A. As best seen in FIG. 2B, faceplate 14A operably engages with the dispenser 12A inside of the dispenser 12A. As described in greater detail below, faceplate 14A also operably engages with a magazine assembly of CMDS and each countermeasure expendable of the set of countermeasure expendables 20 once CMDS 10 is assembled and loaded into the platform 1.

Breechplate assembly 14 also includes a set of first pin mechanisms 14B that operably engages with the faceplate 14A. In the illustrated embodiment, the set of firing pin mechanisms 14B is configured to operably engage with a set of countermeasure expendables (e.g., the set of countermeasure expendables 20) once loaded into the CMDS 10, which is described in more detail below. The set of firing pin mechanisms 14B may be any suitable firing pin mechanisms 14B that are capable of initiating impulse cartridges to dispense countermeasure material from countermeasure expendables known in the art. In one exemplary embodiment, a set of firing pin mechanisms that may be used include firing pin mechanisms described and illustrated in U.S. patent application Ser. No. 17/345,551. In another exemplary embodiment, a set of firing pin mechanisms that may be used include firing pin mechanisms described and illustrated in U.S. patent application Ser. No. 18/045,194. Both of these applications are incorporated herein by reference. While not illustrated herein, the faceplate 14A may be configured to house any suitable electrical connections and/or electrical wiring that operably engages with each firing pin mechanism of the set of firing pin mechanisms 14B. In one exemplary embodiment, the faceplate 14A described and illustrated herein may define cavities and/or recesses to accommodate and/or house any suitable electrical connections and/or electrical wiring that operably engages with each firing pin mechanism of the set of firing pin mechanisms. In one embodiment, there are two pairs of firing pins of the set of firing pin mechanisms 14B may then engage with a respective countermeasure expendable from the set of countermeasure expendables 20. There may be a first pair of firing pins of the set of firing pin mechanisms 14B that operably engages with the squib, and a second pair of firing pins the set of firing pin mechanisms 14B operably engages with the port plug 60 of the respective countermeasure expendable from the set of countermeasure expendables 20. The remaining pairs of firing pins of the set of firing pin mechanisms 14B also engage with the remaining countermeasure expendables from the set of countermeasure expendables 20. One pin from the pair of firing pin mechanism contacts a corresponding fire pin on the squib and the other pin from the pair contacts the conductive annular end of the squib to create a grounded circuit (See FIG. 12B).

Breechplate assembly 14 may also include a rear cover plate 14C that operably engages with the faceplate 14A via connectors (not illustrated). In the illustrated embodiment, rear cover plate 14C is configured to cover and protect a rear surface of the faceplate 14A along with any electrical connections and/or wires that electrically connect to the set of firing pin mechanisms 14B. Upon assembly, the rear cover plate 14C also operably engages with the dispenser 12A inside of said dispenser 12A.

CMDS 10 also includes a magazine assembly 16 that operably engages with the dispenser assembly 12 and the breechplate assembly 14. As best seen in FIG. 2B, magazine assembly 16 is configured to be attached with the breechplate assembly 14 and hold the set of countermeasure expendables 20. Once assembled, the breechplate assembly 14 and the magazine assembly 16 are operably engaged with the dispenser 12A and housed inside of the dispenser 12A with the set of countermeasure expendables 20 loaded inside of the magazine assembly 16. Such components and parts that make up the magazine assembly 16 are described in more detail below.

Magazine assembly 16 includes a magazine 16A. As best seen in FIG. 2B, magazine 16A operably engages with the breechplate assembly 14 and is configured to hold the set of countermeasure expendables 20. More particularly, the magazine 16A operably engages with the faceplate 14A and houses each countermeasure expendables of the set of countermeasure expendables 20. Prior to operably engaging with the faceplate 14A, the set of countermeasure expendables 20 are loaded into the magazine 16A. Once assembled, the breechplate assembly 14 and the magazine assembly 16 operably engage with the dispenser 12A and are housed inside of the dispenser 12A with the plurality of countermeasure expendables 20 being loaded inside of the magazine 16A.

Magazine assembly 16 also includes a set of connectors 16B. As best seen in FIGS. 2A-2B, the set of connectors 16B operably engages the breechplate assembly 14 and the magazine 16A with the dispenser 12A. Upon assembly, a portion of the magazine 16A may protrude outwardly from the dispenser 12A. In one exemplary embodiment, the entire magazine 16A may be disposed inside of the dispenser 12A such that an exterior end or exterior surface of the magazine 16A is flush with a flange of the dispenser 12A upon assembly.

While not illustrated herein, CMDS 10 may include a controller assembly or an embedded fire select multiplexer assembly (EFSM) that operably engages with one or more of the dispenser assembly 12, the breechplate assembly 14, and the magazine assembly 16. If included, controller assembly may also be configured to electrically connect with each firing pin mechanism of the set of firing pin mechanisms 14B for expanding the number of countermeasure expendables from thirty countermeasure expendables in legacy CMDSs (e.g., AN/ALE-47 systems) up to forty-eight countermeasure expendables while using legacy hardware and components. In one example, controller assembly may be controller assembly described and illustrated in U.S. patent application Ser. No. 17/345,551 for expanding the number of countermeasure expendables from thirty countermeasure expendables in legacy CMDSs (e.g., AN/ALE-47 systems) up to forty-eight countermeasure expendables while using legacy hardware and components. In another example, controller assembly may be controller assembly described and illustrated in U.S. patent application Ser. No. 18/045,194 for expanding the number of countermeasure expendables from thirty countermeasure expendables in legacy CMDSs (e.g., AN/ALE-47 systems) up to forty-eight countermeasure expendables while using legacy hardware and components.

CMDS 10 may also include a sequencer 18. As best seen in FIG. 2A, sequencer 18 may electrically connect with the breechplate assembly 14 via the wiring harness 12B of dispenser assembly 12. More particularly, sequencer 18 may electrically connect with each firing pin of the set of firing pins mechanisms 14B of breechplate assembly 14 via wiring harness 12B of dispenser assembly 12. It should be understood that sequencer 18 may be located at any suitable location on the platform 1 while still being able to electrically connect with the breechplate assembly 14 via the wiring harness 12B of dispenser assembly 12.

As discussed previously, CMDS 10 also includes the set of countermeasure expendables 20 that is loaded into the magazine 16A of magazine assembly 16 for countermeasure operations. Each countermeasure expendable of the set of countermeasure expendables 20 may include countermeasure material (e.g., chaff material, flare material, etc.) for deterring enemy threats away from the platform 1 during combat and/or military operations. Such parts and components of each countermeasure expendable of the set of countermeasure expendables 20 are discussed in greater detail below.

Figure 3:
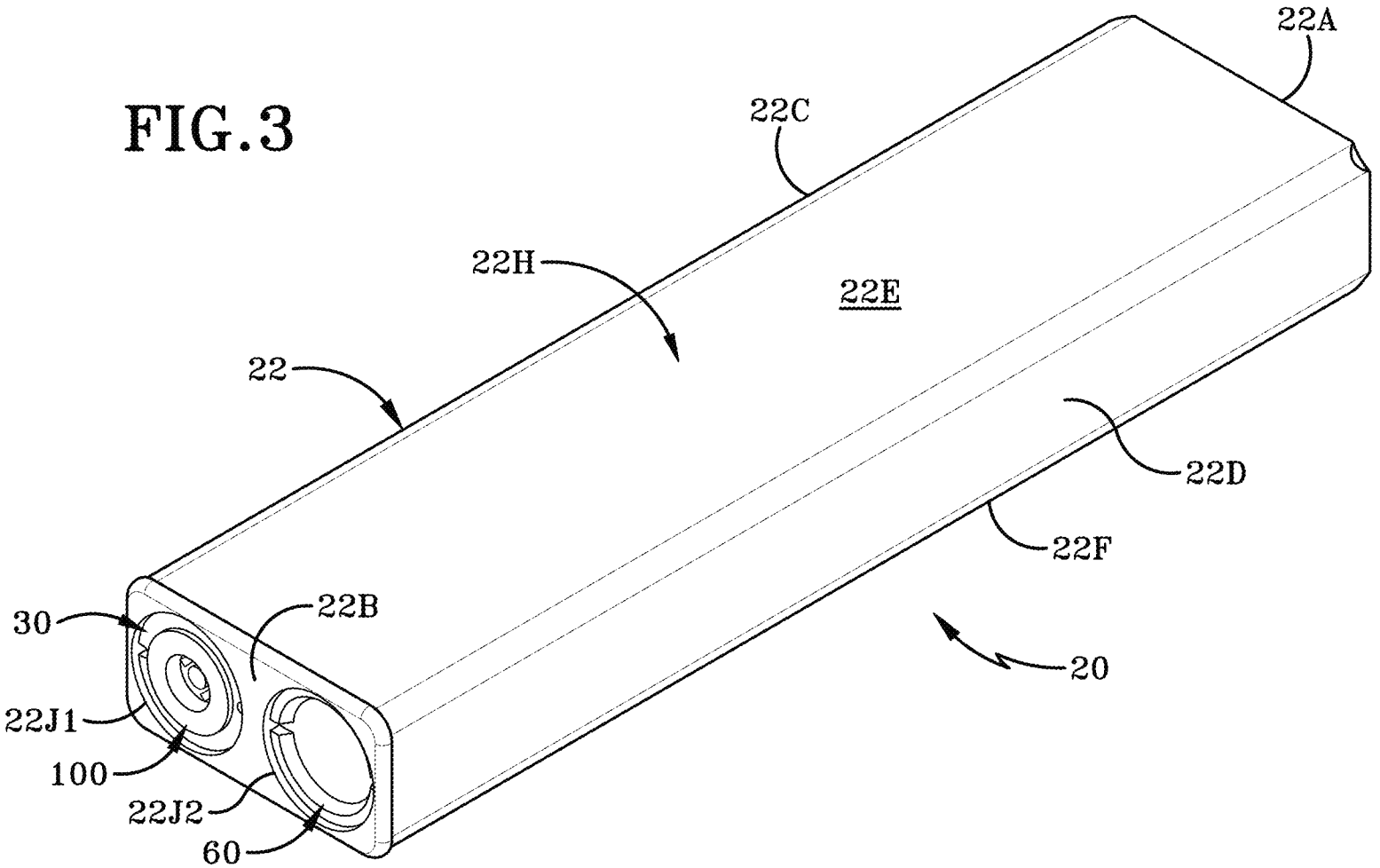
FIG. 3 (FIG. 3) is a top, rear, second side isometric perspective view of a countermeasure expendable of the set of countermeasure expendables.

Each countermeasure expendable of the set of countermeasure expendable 20 includes a canister 22. As best seen in FIG. 3, canister 22 includes a front wall 22A, and rear wall 22B longitudinally opposite to the front wall 22A, and a longitudinal axis defined therebetween. Canister 22 also includes a first side wall 22C extending between the front wall 22A and the rear wall 22B, a second side wall 22D extending between the front wall 22A and the rear wall 22B and transversely opposite to the first side wall 22C, and a transverse axis defined therebetween. Canister 22 also includes a top wall 22E that is positioned vertically above the front wall 22A, the rear wall 22B, the first side wall 22C, and the second side wall 22D, a bottom wall 22F that is positioned vertically below the front wall 22A, the rear wall 22B, the first side wall 22C, and the second side wall 22D and vertically opposite to the top wall 22E, and a vertical axis defined therebetween.

Figure 5:
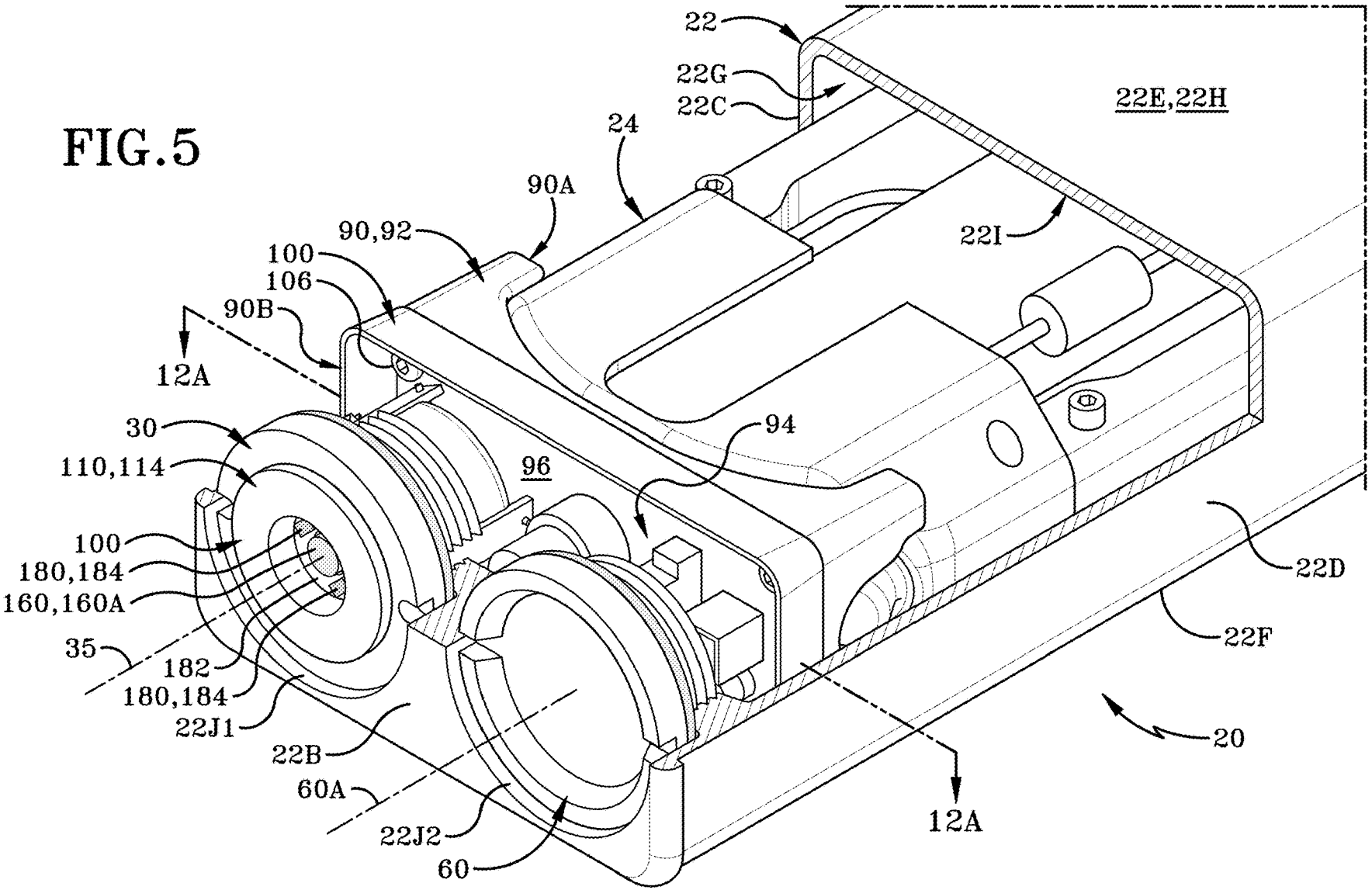
FIG. 5 (FIG. 5) is a rear cutaway view of a canister of the countermeasure expendable shown in FIG. 3.

Canister 22 also defines a chamber 22G. As best seen in FIG. 5, chamber 22G is collectively defined by the front wall 22A, the rear wall 22B, the first side wall 22C, the second side wall 22D, the top wall 22E, and the bottom wall 22F. Canister 22 also includes an exterior surface 22H that extends along each of the front wall 22A, the rear wall 22B, the first side wall 22C, the second side wall 22D, the top wall 22E, and the bottom wall 22F external to or outside of the chamber 22G. Canister 22 also includes an interior surface 22I that extends along each of the front wall 22A, the rear wall 22B, the first side wall 22C, the second side wall 22D, the top wall 22E, and the bottom wall 22F internal to or inside of the chamber 22G.

Figure 6:
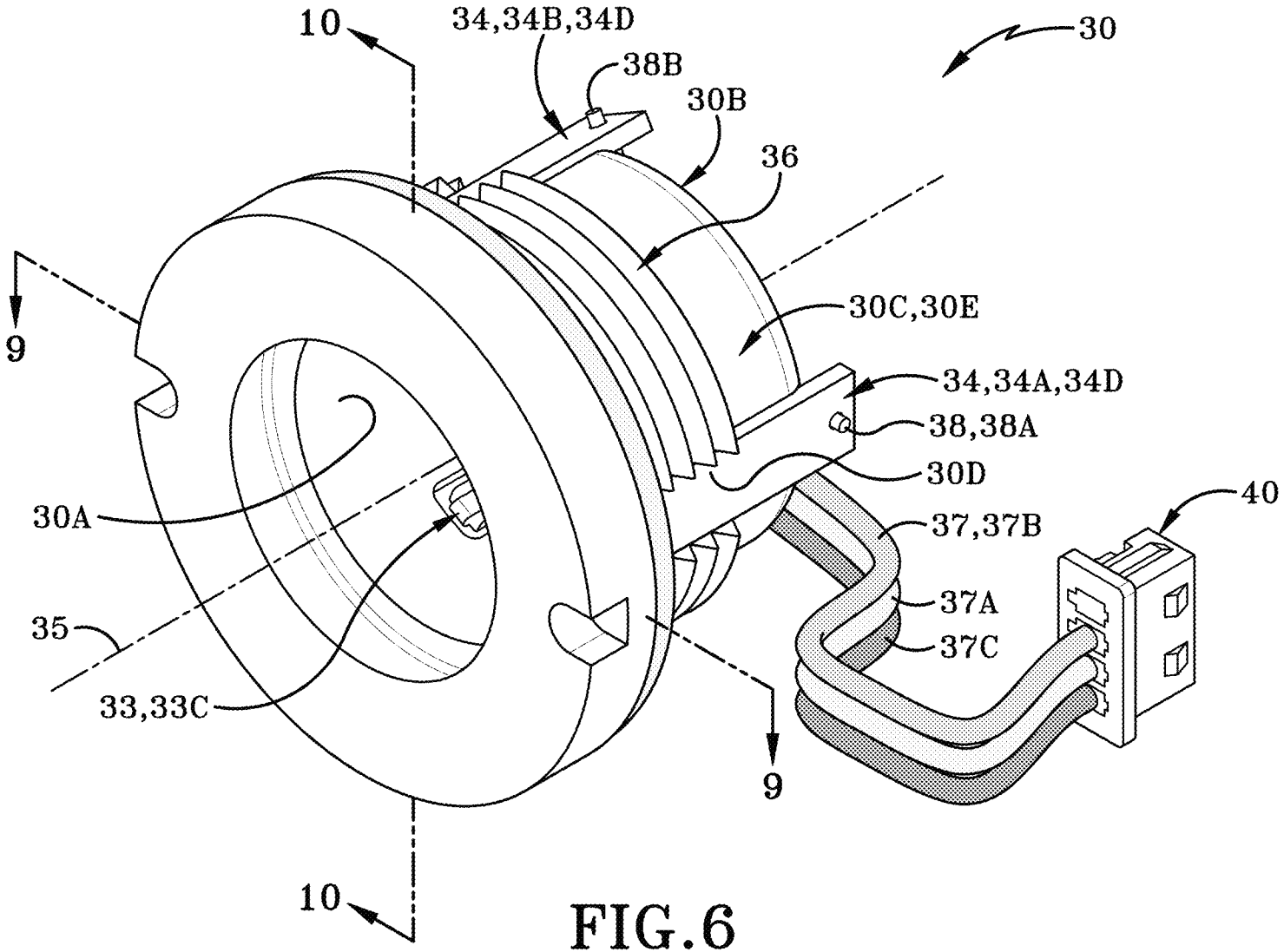
FIG. 6 (FIG. 6) is a front perspective view of an impulse cartridge cup according to an exemplary embodiment of the present disclosure.
Figure 7:
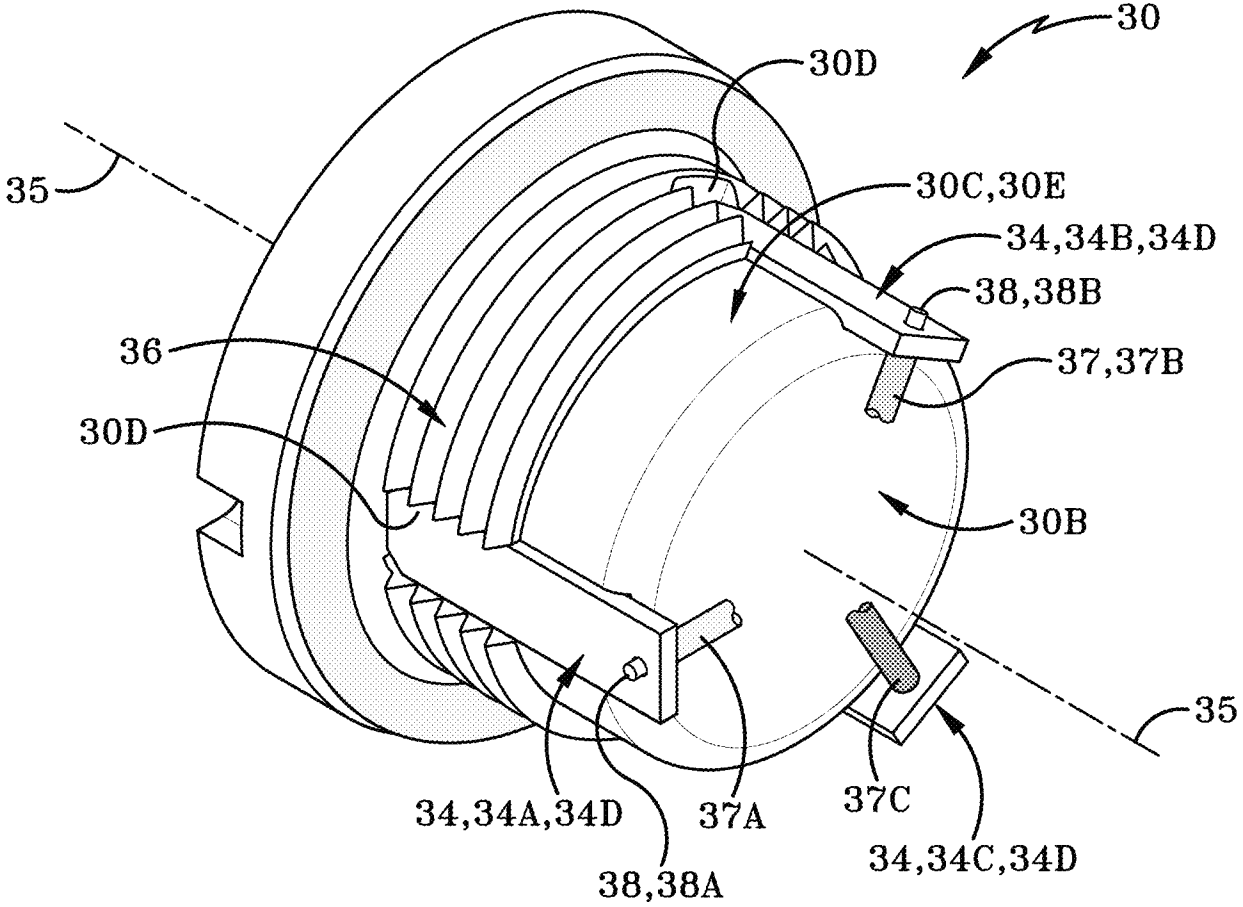
FIG. 7 (FIG. 7) is a rear perspective view of an impulse cartridge cup according to an exemplary embodiment of the present disclosure.

Canister 22 also defines at least one threaded opening 22J. As best seen in FIGS. 5-6, canister 22 defines a first threaded opening 22J1 that extends longitudinally from the rear wall 22B towards the front wall 22A. Canister 22 also defines a second threaded opening 22J2 that extends longitudinally from the rear wall 22B towards the front wall 22A. As best seen in FIG. 5, the first threaded opening 22J1 and the second threaded opening 22J2 are adjacent with one another and are transversely opposite one another relative to a longitudinal centerline. The first threaded opening 22J1 also provides open communication between the chamber 22G defined in canister 22 and the external environment surrounding the canister 22. Similarly, the second threaded opening 22J1 also provides open communication between the chamber 22G defined in canister 22 and the external environment surrounding the canister 22. Such uses of the first threaded opening 22J1 and the second threaded opening 22J2 are discussed in greater detail below.

Each countermeasure expendable of the set of countermeasure expendables 20 may also include a payload 24. As best seen in FIG. 5, payload 24 may be any suitable countermeasure material that, when ejected from canister 22, diverts or deters one or more enemy threats away from the platform 1. Payload 24 may also include a processing unit or microprocessor that is configured to eject and dispense the countermeasure material at a suitable distance away from the platform 1 dictated by the military operation.

Figure 4:
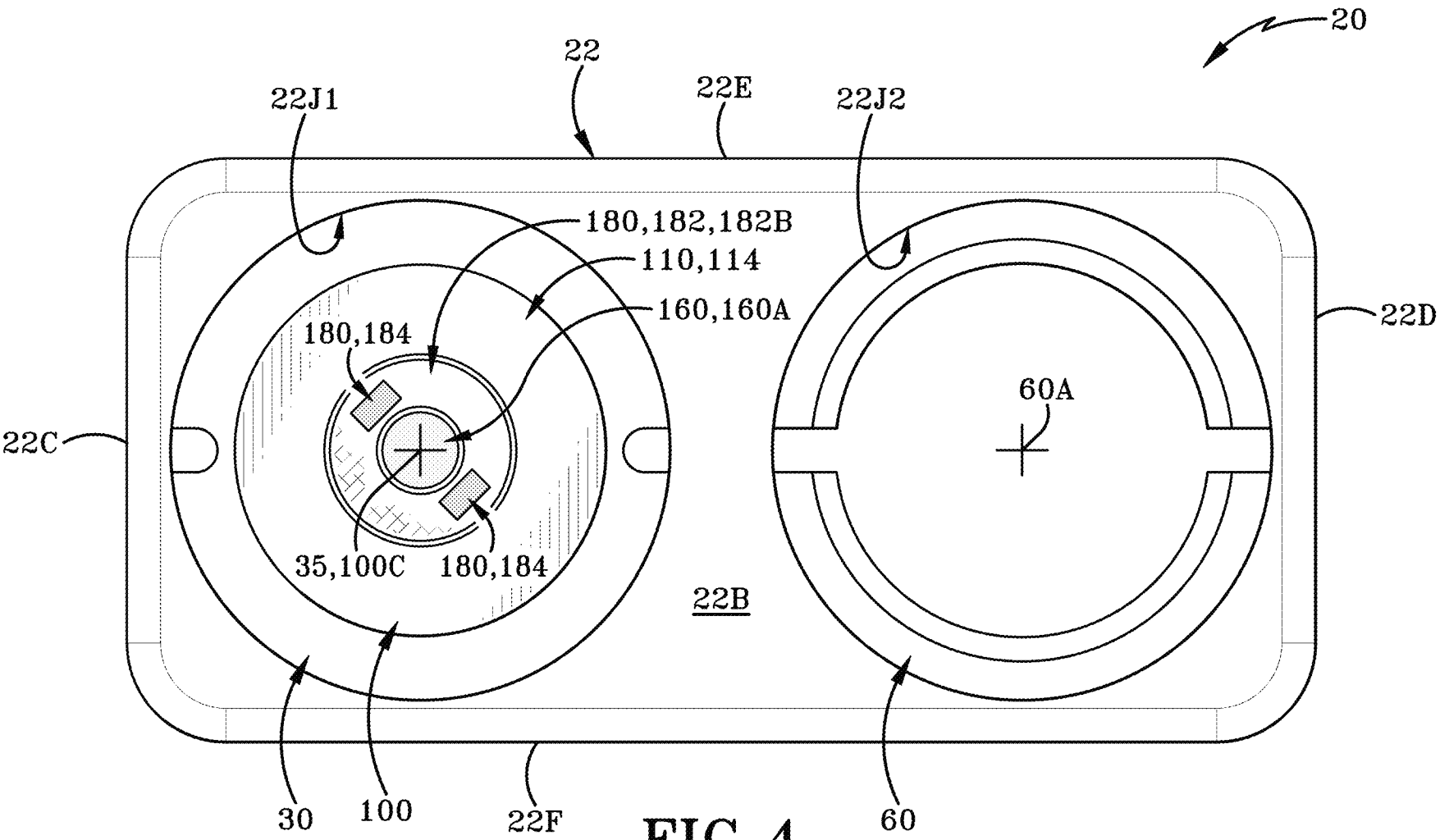
FIG. 4 (FIG. 4) is a rear elevation view of the countermeasure expendable shown in FIG. 3.

Each countermeasure expendable of the set of countermeasure expendables 20 may also include an impulse cartridge or squib. As best seen in FIGS. 4-5, squib is configured to eject the payload 24 and other components of the countermeasure expendable 20 (discussed in greater detail below) from the canister 22 for dispensing countermeasure material at a suitable distance away from the platform 1 as dictated by the military operation.

Each countermeasure expendable of the set of countermeasure expendables 20 may also include an impulse cartridge cup 30. As best seen in FIG. 5, impulse cartridge cup 30 operably engages with the rear wall 22B of the canister 22. More particularly, impulse cartridge cup 30 may threadably engage with the rear wall 22B of the canister 22 via the first threaded opening 22J1. Upon engagement with canister 22, a portion of the impulse cartridge cup 30 is positioned inside of the canister 22 in which impulse cartridge cup 30 effectuates communication between the chamber 22G of canister 22 and the external environment of the canister 22 at the first threaded opening 22J1. Upon engagement with canister 22, a portion of impulse cartridge cup 30 is also partially positioned outside of chamber 22G of canister 22. As best seen in FIGS. 17A-17B, impulse cartridge cup 30 is configured to receive and house squib for ejecting and dispensing the countermeasure material at a suitable distance away from the platform 1 dictated by the military operation. As discussed in greater detail below, impulse cartridge cup 30 may also be configured to send and/or output at least one signal to a smart piston of countermeasure expendable 20 upon engaging with squib.

The impulse cartridge (IC) cup 30 is a high precision cup that is shaped generally like a thimble that is configured to be connected to an end or rear wall 22B of canister 22 that stores a dispensable or expendable payload 24. The IC cup 30 has a body composed of a endwall 30B and a sidewall 30C that collectively define a cavity 30A that is configured to receive an impulse cartridge or squib in order to fire or project the payload upon explosion of the squib/impulse cartridge. The cavity 30A may be plugged with a flexible gasket-type plug when the squib is not inserted into the cavity 30A. The end or endwall 30B of the IC cup 30 is machined with purposeful perforations or destruction lines that purposely deteriorate or break in response to the explosion of the squib. The body of IC cup 30 extends from a first end to a second end that is defined by end wall 30B. The body of IC cup extends along a primary axis 35 from the first end to the second end. There may be an annular collar of the body at the first end, wherein the annular collar defines an opening adapted to receive an impulse cartridge (or squib) therethrough.

The cylindrical sidewall 30C of the body extends from the annular collar towards the second end. The cylindrical sidewall circumscribes the primary axis 35. The cylindrical sidewall 30C has an outer surface and inner surface, wherein a thickness of the sidewall is measured in a radial direction relative to the primary axis 35 between the outer surface and the inner surface, wherein the inner surface defines cavity 30A that is in open communication with the opening of the annular collar and adapted to receive the squib therein. At least a portion of the outer surface of the cylindrical sidewall 30C is threaded, as evidenced by threads 36.

The IC cup 30 of the present disclosure enables signals to be sent through the IC cup 30 without disrupting the high precision burst plate or end wall 30B that has the purposefully constructed weakened lines or perforations. Stated otherwise, the weakened lines, which also may be referred to as score lines, are highly regulated and precisely machined to ensure that constant pressure is applied into the cavity of the payload upon explosion of the squib. Therefore, the IC cup 30 of the present disclosure enables signals to be sent through the IC cup 30 by constructing or defining a plurality of apertures 32 or through holes or openings that are defined in the sidewall 30C of the IC cup 30 and extend fully through the sidewall 30C from its inner surface to its exterior or outer surface 30E. This eliminates the need for any wires or electrical signal transmission paths to pass through the end wall 30B because of the high precision required for the weakened lines to burst at a precise pressure.

Figure 8:
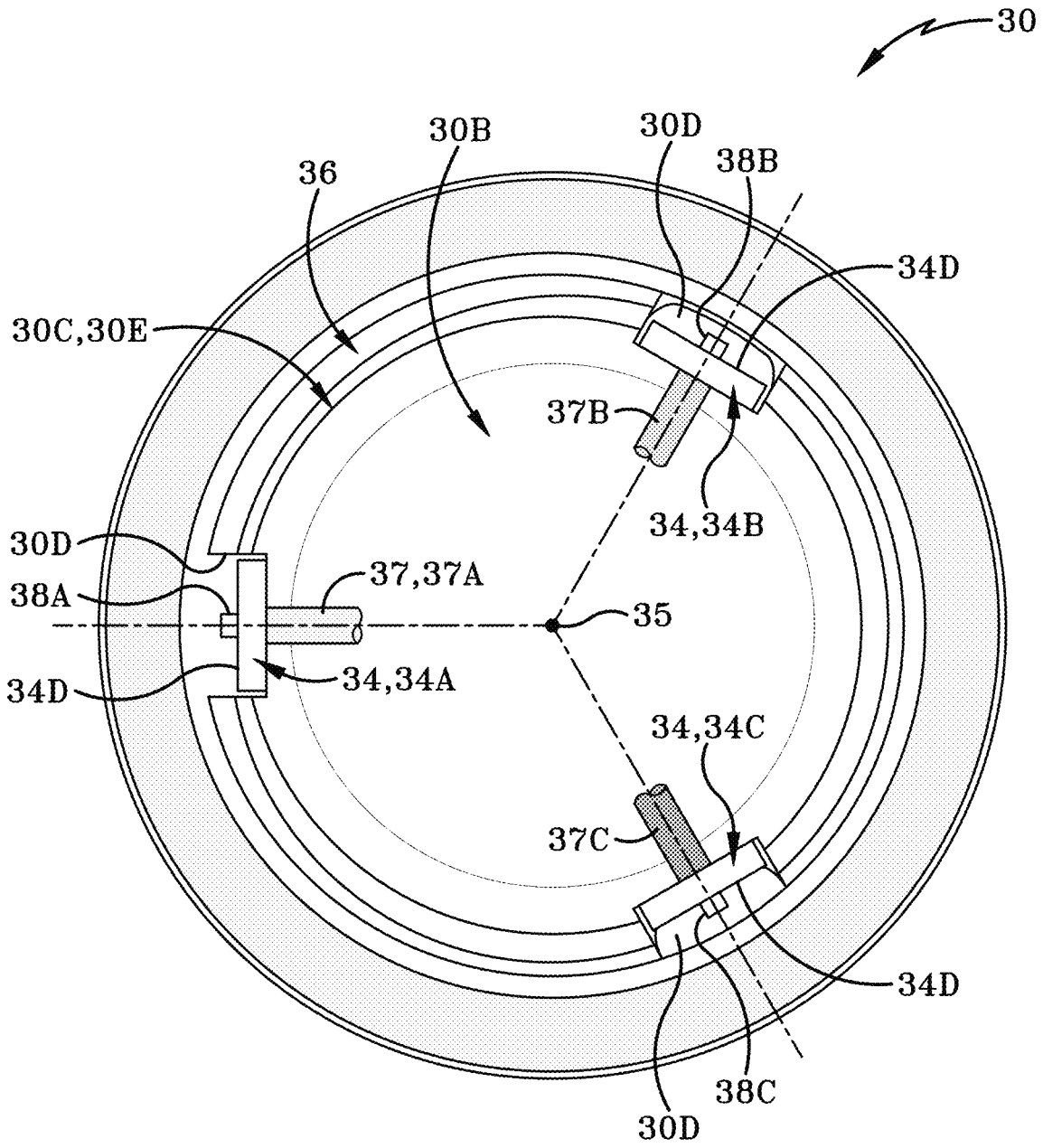
FIG. 8 (FIG. 8) is a rear end elevation view of an impulse cartridge cup according to an exemplary embodiment of the present disclosure.

In one specific example, there are at least three electrical connectors 33 carried by IC cup 30. In order for electrical connectors 33 to be disposed through the sidewall 30C of the IC cup 30, the exterior surface of sidewall 30C of IC cup 30 may be machined, drilled, or otherwise cut away to create a channel or kerf 30D that receives a carrier board 34 to dispose an electrical connector 33 within an aperture 32 that is in open communication with the cavity 30A of IC cup 30. More particularly, a first carrier board 34A carriers a first electrical connector 33A, a second carrier board 34B carriers a second electrical connector 33B, and a third carrier board 34C carriers a third electrical connector 33C. As depicted in FIG. 8, one exemplary embodiment may provide that each carrier board that carries one electrical connector 33 is offset 120° from an adjacent electrical connector relative to a central primary axis 35.

Each channel 30D on the exterior surface 30E of the IC cup 30 allows each carrier board 34 to be disposed below the exterior threads 36 formed in the outer surface 30E. For example, the lowermost surface of thread 36 relative to a central primary axis 35, which may be considered the nadir or valley 36A of each thread is located slightly above or coplanar with an exterior surface 34D of each carrier board 34 so as to allow the threads 36 to still operate to connect with corresponding threads on the first threaded opening 22J1 of canister 22 without having any interference by the carrier board 34. Furthermore, the peaks of the threads on the first opening 22J1 will contact the exterior surface 34D of the carrier board 34 to assist with retaining the carrier board 34 in position when an explosion or pressure occurrence happens to ensure that the electrical components or connectors 33 carried by each carrier board 34 stay connected to the squib or impulse cartridge that is retained in the IC cup 30.

In one particular embodiment, each electrical connector 33 is a bowlegged spring connector. A typical bowlegged spring connector is a small component typically on the order of about 0.04 inches in width. In other embodiments, a different electrical connector may be utilized. The manner in which the electrical connector 33 is connected to the carrier board 34 may be accomplished through a re-flow connection technique. Hand soldering is likely not possible given the small size of the electrical connector 33, however might be possible if enough precision can be achieved so as to not create an electrical connection between the solder and the sidewall 30C of IC cup 30. Each electrical connector is disposed within one of the aperture 32 formed in the sidewall 30C of the IC cup 30 but does not touch the sidewall of the IC cup 30. As such, there is a gap 32A between the first end of the electrical connector 33 and the sidewall 30C of the IC cup 30 and there is a gap 32B between the second end of the electrical connector 33 and the sidewall 30C of the IC cup 30. In one particular embodiment, the two gaps 32A, 32B ensure that the electrical connector does not short out or ground to the body or sidewall of the IC cup 30.

A depth of a first channel 30D substantially equals or approximates a dimensional sum of a thickness of the first carrier board 34A in the first channel and a thickness of a layer of adhesive or epoxy to adhere or bond the first carrier board 34A in the first channel that is adapted to dispose an outer surface of the first carrier board 34D complementary to a nadir 36A of at least one thread 36 in the outer surface of sidewall 30C. A depth of the second channel substantially equals or approximates a dimensional sum of a thickness of a second carrier board 34B in the second channel and a thickness of a layer of adhesive or epoxy to adhere or bond the second carrier board 34B in the second channel that is adapted to dispose an outer surface of the second carrier board 34B complementary to the nadir 36A of at least one thread 36 in the outer surface of sidewall 30C. A depth of the third channel substantially equals or approximates a dimensional sum of a thickness of a third carrier board 34C in the third channel and a thickness of a layer of adhesive or epoxy to adhere or bond the third carrier board 34C in the third channel that is adapted to dispose an outer surface of the third carrier board complementary to the nadir 36A of at least one thread 36 in the outer surface of sidewall 30C.

Figure 9:
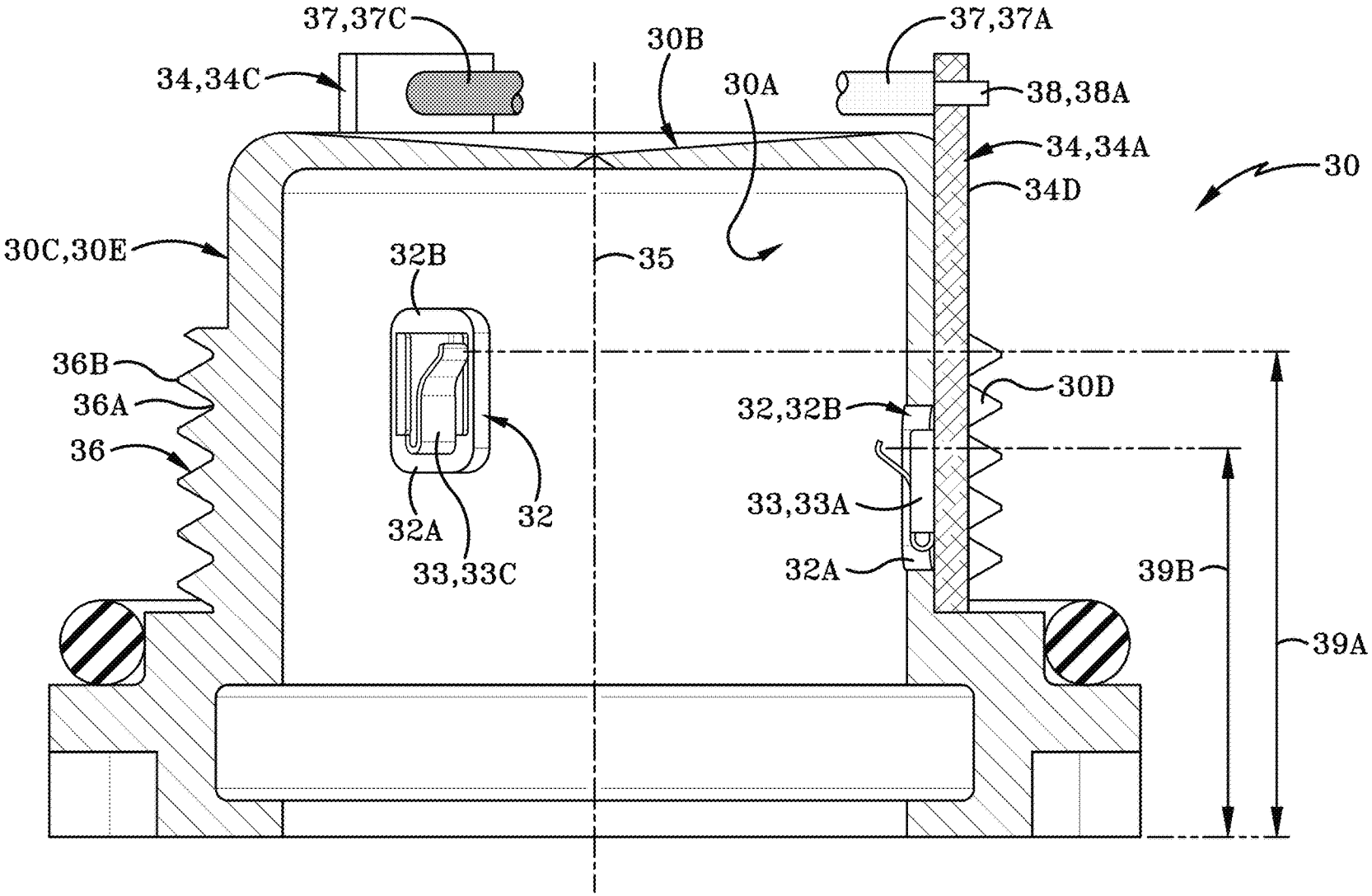
FIG. 9 (FIG. 9) is a cross section view of the impulse cartridge cup taken along line 9-9 in FIG. 6.
Figure 10:
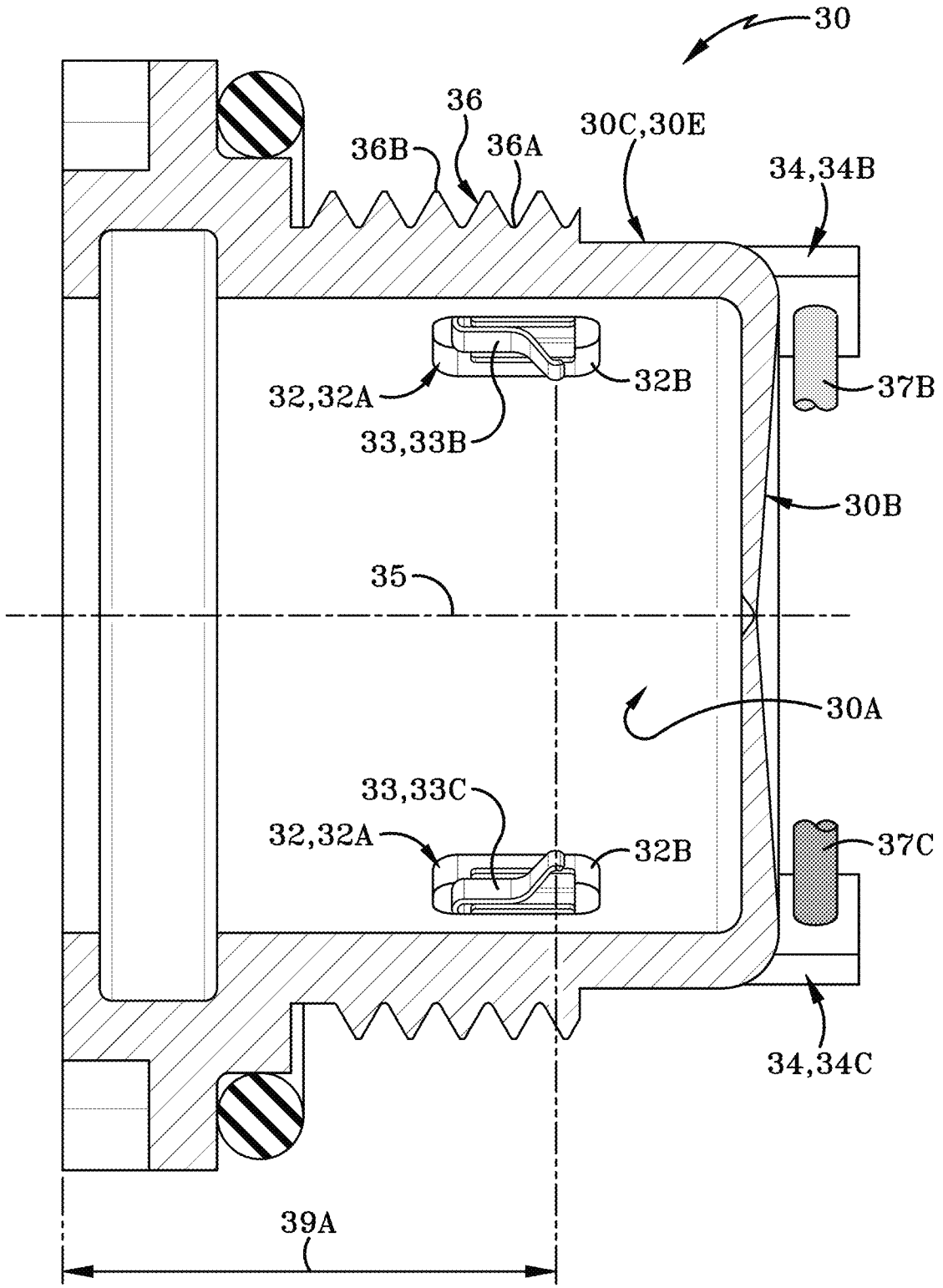
FIG. 10 (FIG. 10) is a cross section view of the impulse cartridge cup taken along line 10-10 in FIG. 6.
Figure 11:
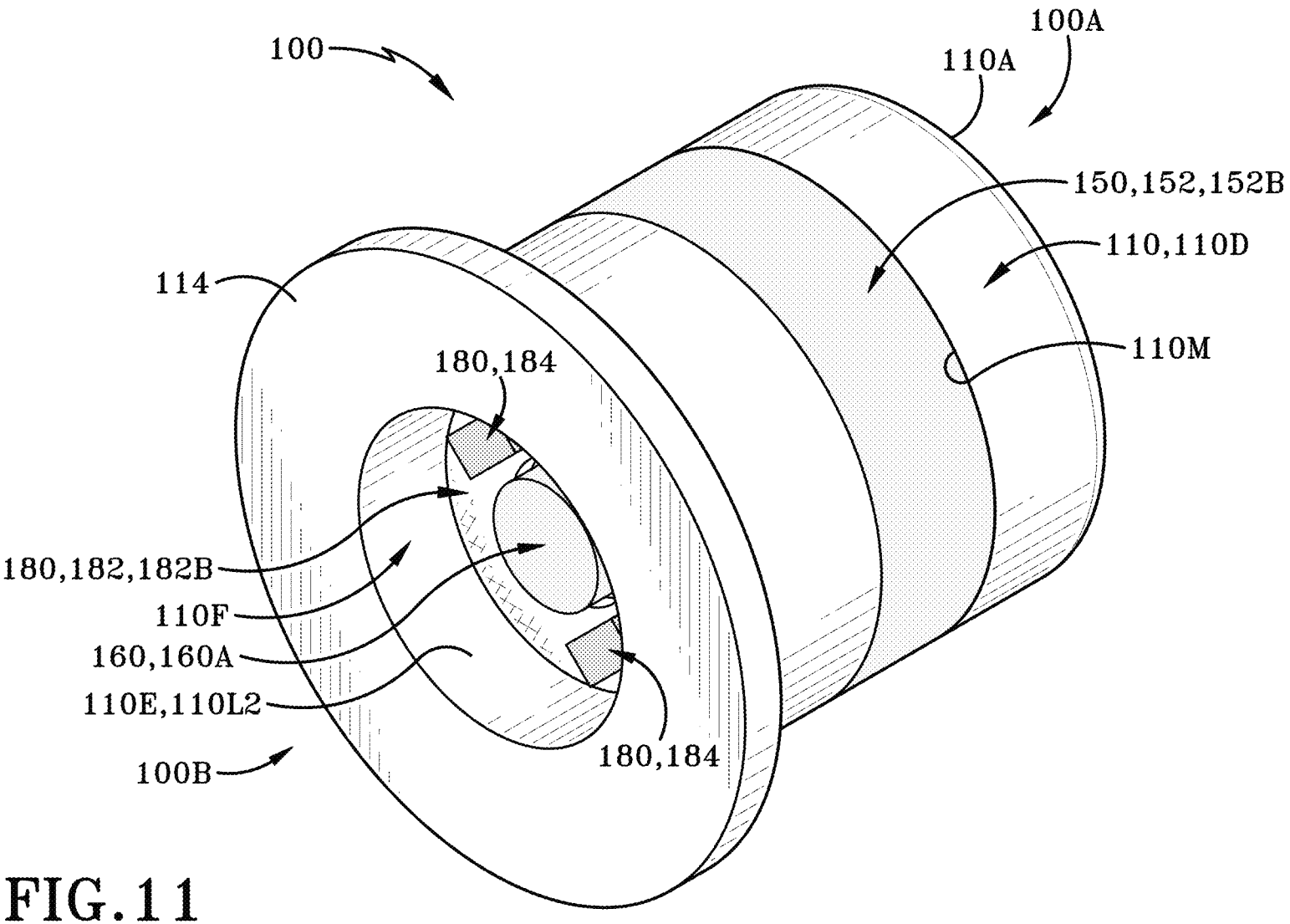
FIG. 11 (FIG. 11) is a top, rear, first side isometric perspective view of a smart store communication interface (SSCI) squib according to an exemplary embodiment of the present disclosure.

Each carrier board 34 has an end that extends from the IC cup 30. Each end is coupled with a respective wire 37 that is connected with a common connector, which is generally referred to as connector 40, to a port on the back of the piston assembly or piston 90. The wire 37A connected to the carrier board 34A via pin 38A carries the serial communication signals to the connector 40 for transmission into the payload 24. The carrier board 34A carrying the electrical connector 33A for the serial communication signal is longer than the other two carrier boards 34B, 34C because the longer board needs to enable the electrical connector 33A for communication signals to contact the electrically conductive annular ring on the smart squib while the other two shorter carrier boards 34B, 34C allow for the other two electrical connectors 33B, 33C to ground or otherwise short to the squib body via wires 37B, 37C, respectively. Thus, relative to the longitudinal length of the cylindrical sidewall 30C of the IC cup 30, two of the electrical connectors 33B, 33C are at the same longitudinal position, as depicted by dimension 39A, and the first electrical connector 33A or at least one other electrical connector is at a different position, as depicted by dimension 39B, relative to the longitudinal length of the IC cup 30. Dimension 39B is smaller than dimension 39A when measured relative to the opening to the cavity 30A (see FIG. 9). More particularly, a first opening or aperture edge bounds and defines the first opening or aperture. A second opening or aperture edge bounds and defines the second opening or aperture. A third opening or aperture edge bounds and defines the third opening. The second opening edge and the third opening edge are coplanar along a first radial plane, as evidenced by dimension 39A, and the first opening edge lies along a second radial plane, wherein the second radial plane is closer to the first end of the body than the first radial plane, as evidenced by dimension 39B.

With respect to the wires 37, the first wire 37A is the serial communication wire. The second wire 37B is the ground wire. The third wire 37C is the enable wire, which effectively provides communication to an enable pin on piston 90, wherein the enable pin is in electrical communication with the processor of the payload 24. Thus, whenever a squib is plugged in to the IC cup 30 of the present disclosure, the second electrical connector 33B shorts out the third electrical connector 33C by both touching the case or housing of squib simultaneously. This electrical short is accomplished because the case or body of squib is conductive and thereby connects the second wire 37B to the third wire 37C to effectively short out to enable the small battery or coin cell battery 202 that enables the microprocessor to start functioning with the payload 24, and the signals that are enabled to be activated are transmitted through the serial communication wire 37A associated with the first connector 33A contacting the outer annular ring of the smart squib or smart impulse cartridge.

The IC cup 30 of the present disclosure is configured to be used with any type of impulse cartridge or squib. One exemplary squib is a smart squib or smart impulse cartridge. Although the IC cup 30 of the present disclosure has been discussed herein with respect to a smart impulse cartridge or smart squib, the IC cup of the present disclosure can be utilized with a conventional or "dumb" squib that does not have any electrical communications there through. When using a conventional squib, the conventional squib will be inserted into the cavity of the IC cup 30 of the present disclosure (after removing the plug) and all three electrical contacts or connectors 33A, 33B, and 33C will contact the exterior surface of the conventional squib and short out. Thus, when they short and ground to each other, it will activate the payload 24 inside the canister 22 or cartridge case or housing. This allows the IC cup 30 of the present disclosure to be backwards compatible with previous legacy conventional squibs in conjunction with future developed smart squibs.

Each countermeasure expendable of the set of countermeasure expendables 20 may also include a port plug 60. As best seen in FIG. 5, port plug 60 operably engages with the rear wall 22B of the canister 22. More particularly, port plug 60 may threadably engage with the rear wall 22B of the canister 22 via the second threaded opening 22J2. Upon engagement with canister 22, port plug 60 is positioned entirely inside of the canister 22 in which port plug 60 impedes communication between the chamber 22G of canister 22 and the external environment of the canister 22 at the second threaded opening 22J2. Upon engagement with canister 22, port plug 60 is also partially positioned inside of chamber 22G of canister 22. During operation, port plug 60 may be removed and/or threadably disengaged from the second threaded opening 22J2 for testing operations, which are discussed in greater detail below.

Each countermeasure expendable of the set of countermeasure expendables 20 may also include a smart piston 90. As best seen in FIGS. 5-6, smart piston 90 includes a main body 92 that operably engages with the canister 22 forwardly of the rear wall 22B, the impulse cartridge cup 30, and the port plug 60. More particularly, smart piston 90 operably engages with the first side surface 22C, the second side surface 22D, the top wall 22E, and the bottom wall 22F inside of the chamber 22G along the interior surface 22I. As discussed in greater detail below, smart piston 90 enables one or more electrical signals to be passed between the payload 24 and the impulse cartridge cup 30 during testing operations and firing operations.

Figure 19:
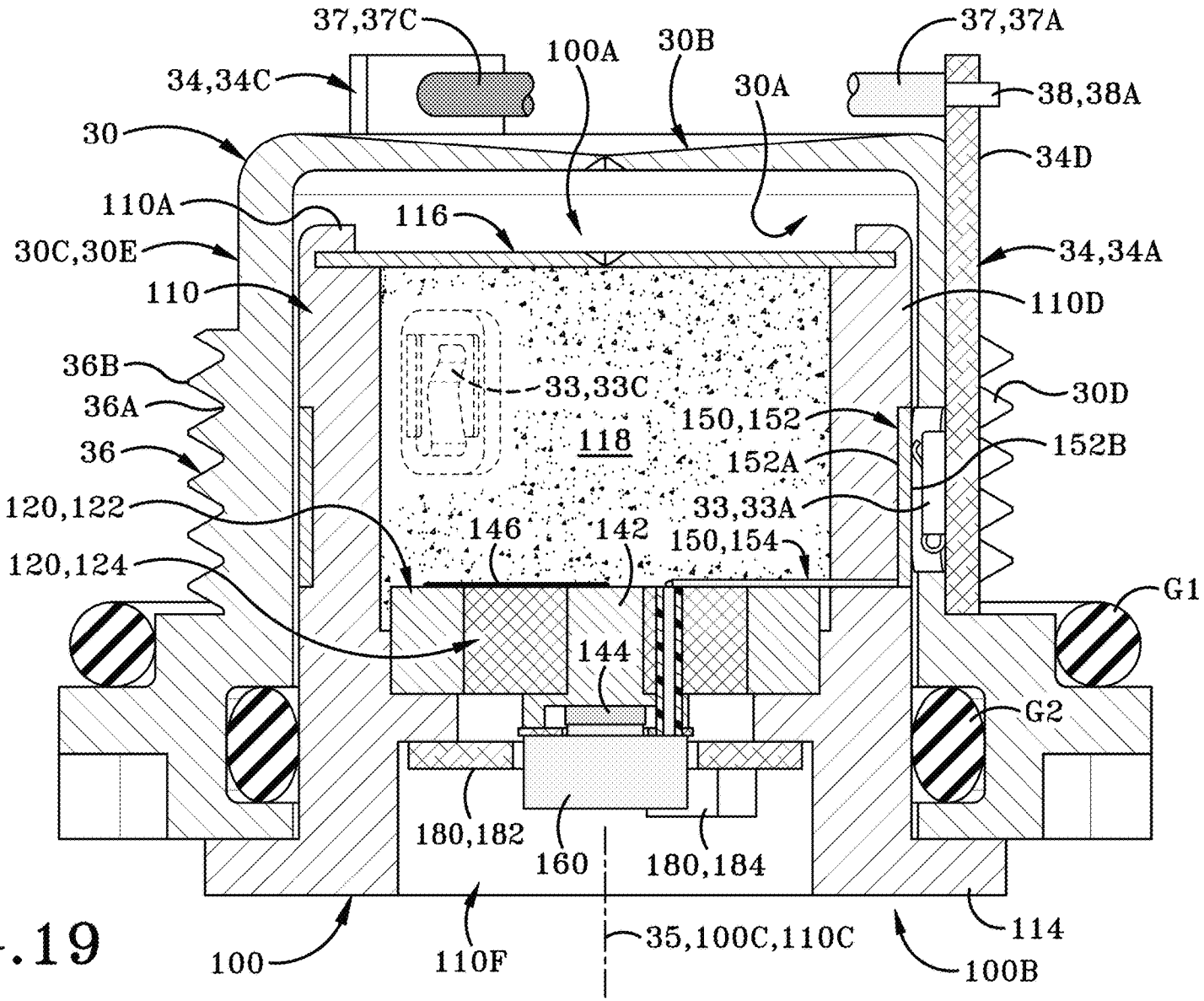
FIG. 19 (FIG. 19) is a longitudinal section view of the IC cup and the SSCI squib, wherein the SSCI squib is loaded into the IC cup.

Each countermeasure expendable of the set of countermeasure expendables 20 may also include a smart store communication interface (SSCI) squib (hereinafter "squib") generally referred to as 100. As best seen in FIG. 19, squib 100 includes a first end 100A, a second end 1001B longitudinally opposite to the first end 100A, and a main longitudinal axis 1000 defined therebetween that is coaxial with primary axis 35. In operation, squib 100 is inserted into the IC cup 30 until the second end 100B of the squib 100 engages with the IC cup 30 and the sidewall of the squib 100 contacts each electrical connector of the set of electrical connectors 33. As described in greater detail below, squib 100 is configured to ignite a propellant loaded inside of the squib 100 and/or communicate with a processor of the countermeasure expendable 20 in response to receiving at least one electrical signal at a fire pin contact of squib 100.

The components and parts of the squib 100 are now described in greater detail below.

Squib 100 includes a housing 110. As best seen in FIGS. 11-14, housing 110 includes a first end 110A, a second end 110B longitudinally opposite to the first end 110A, and a longitudinal axis 110C defined therebetween that is coaxial with primary axis 35 of IC cup 30 (see FIG. 14). Housing 110 also includes an exterior wall 110D that extends longitudinally between the first end 110A and the second end 110B and electrically contacts at least two electrical connectors of the set of electrical connectors 33, particularly the second electrical connector 33B and the third electrical connector 33C; such electrical connection between the housing 110 and the set of electrical connectors 33C is discussed in greater detail below. Housing 110 also includes an interior wall 110E that extends longitudinally between the first end 110A and the second end 110B and faces an opposing direction relative to the exterior wall 110D. The interior wall 110E of housing 110 also defines a main passageway 110F that extends between the first end 110A and the second end 110B. As discussed in greater detail below, the main passageway 110F may be sealed off at the first end 110A and/or the second end 110B of the housing 110.

Figure 14:
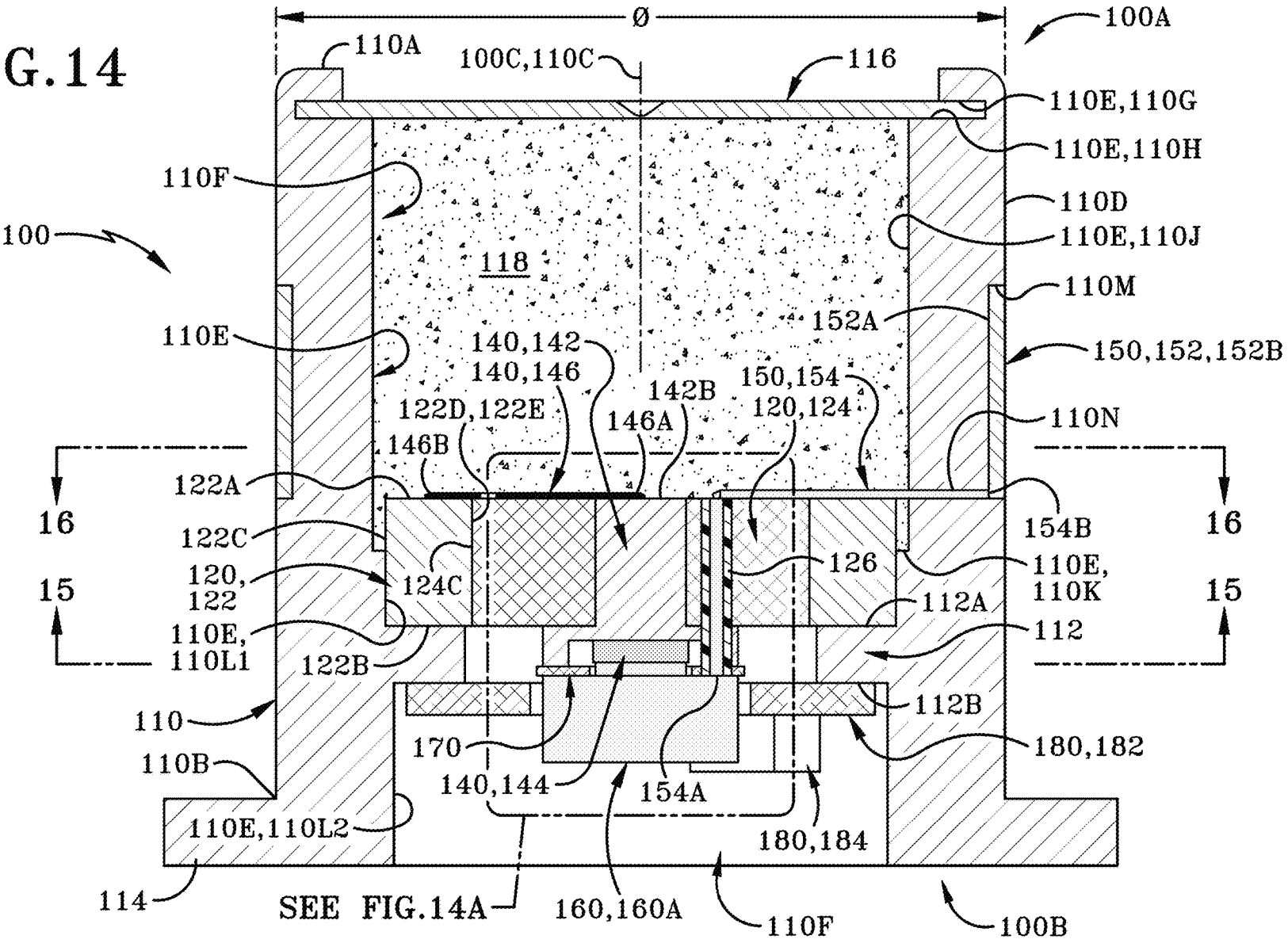
FIG. 14 (FIG. 14) is a longitudinal section view of the SSCI squib taken along line 14-14 in FIG. 13.

Still referring to housing 110, housing 110 may include a plurality of interior portions or walls that collectively form the interior wall 110E. As best seen in FIG. 14, housing 110 may include a securement wall 110G and a first base wall 110H that extend into the housing 110 where the securement wall 110G is positioned vertically above the first base wall 110H. As discussed in greater detail below, the securement wall 110G and a portion of the exterior wall 110D may be bent and/or crimped rearward to seal off the main passageway 110F at the first end 100A (see FIG. 14). Housing 110 may also include a first interior portion 110J that extends rearward from the first base wall 110H to a second base wall 110K. Housing 110 may also include a second interior portion 110L1 that extends rearward from the second base wall 110K to an internal extension of housing 110, which is discussed in greater detail below. Housing 110 may also include a third interior portion 110L2 that extends forwardly from the rear end 110B to the internal extension of housing 110.

Housing 110 also defines a notch or recess 110M that extends radially into the exterior wall 110D and is disposed about the exterior wall 110D external to the interior wall 110E. In the present disclosure, the notch 110M is spaced apart from the main passageway 110F defined in the housing 110. Such use and purpose of the notch 110M is discussed in greater detail below.

Housing 110 also defines a side passageway 110N that extends entirely through the housing 110 along an axis that is perpendicular to the longitudinal axis 110C of the housing. In the present disclosure, the exterior wall 110D and the interior wall 110E are in fluid communication with one another at the side passageway 110N. In the present disclosure, the main passageway 110F and the notch 110M are also in fluid communication with one another at the side passageway 110N (see FIG. 14). Such use and purpose of side passageway 110N is also discussed in greater detail below.

Housing 110 also defines an outer diameter Ø. As best seen in FIG. 14, the outer diameter Ø is defined by the exterior wall 110D. The outer diameter Ø is continuous from the first end 110A of the housing 110 to the second end 110B of the housing 110. In the present disclosure, the outer diameter Ø of housing 110 is less than the inner diameter of IC cup 30 so that housing 110 may be received by the IC cup 30 and be engaged with the IC cup 30 for enabling electrical communication between the IC cup 30 and squib 100 (discussed in greater detail below).

Housing 110 also includes an internal extension 112. As best seen in FIG. 14, the internal extension 112 extends radially into the main passageway 110F from the interior wall 110E. Internal extension 112 includes a front surface 112A that faces forwardly towards the first end 110A, a rear surface 112B that faces rearward towards the second end 110B, and a through-hole 112C defined in the internal extension 112 that extends between the front surface 112A and the rear surface 112B. Such use and purpose of the internal extension 112 is discussed in greater detail below.

Housing 110 also includes a lip 114. As best seen in FIG. 14, the lip 114 extends radially outward from the outer wall 110D at the second end 110B. In operation, the lip 114 is configured to directly abut the IC cup 30 to limit the amount of travel of the squib 100 inside of the IC cup 30 (see FIG. 19). In the present disclosure, the lip 114 defines a greater outer diameter than the outer diameter Ø defined by the exterior wall 110D.

Squib 100 also includes a rupture disk 116 that operably engages with the housing 110. As best seen in FIG. 14, rupture disk 116 operably engages with the housing 110 at the first end 110A by crimping or folding a portion of the housing 110 on the rupture disk 116. More particularly, the securement wall 110G and the first base wall 110H operably engage with the rupture disk 116 due to a portion of the housing 110 being crimped and folded rearward onto the rupture disk 116.

Figure 12:
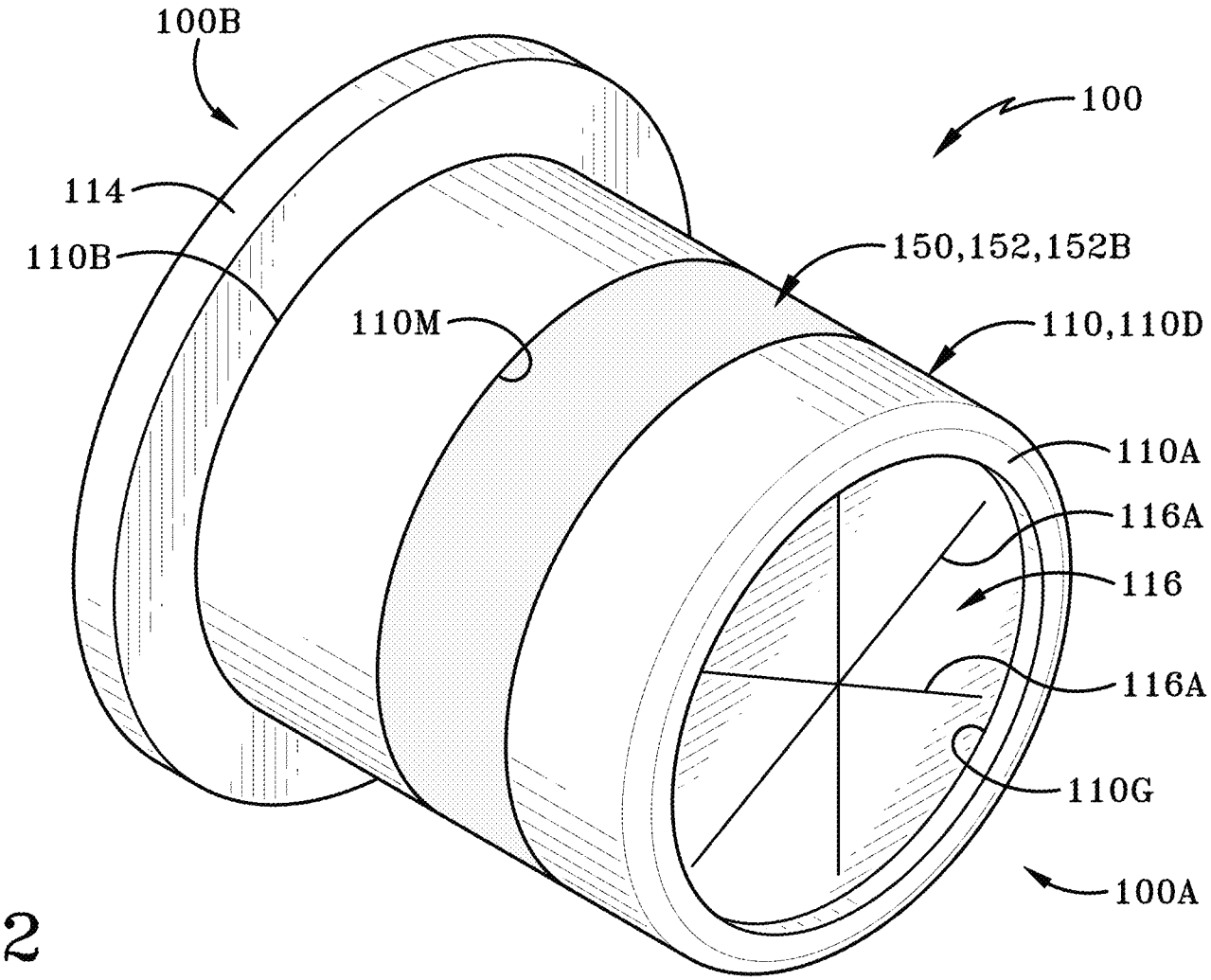
FIG. 12 (FIG. 12) is a front, top, first side isometric perspective view of the SSCI squib shown in FIG. 11.
Figure 13:
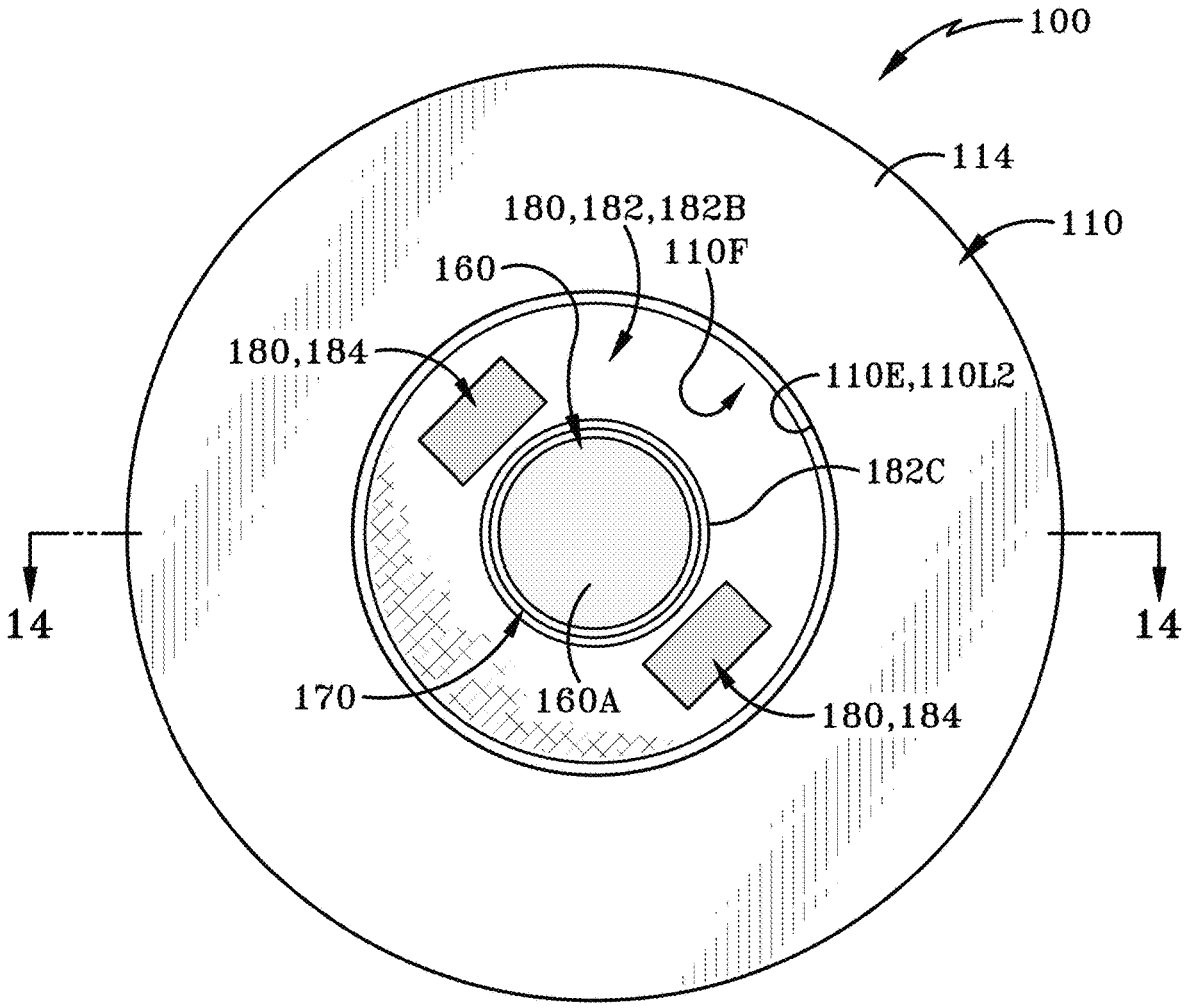
FIG. 13 (FIG. 13) is a rear elevation view of the SSCI squib shown in FIG. 11.

As best seen in FIG. 12, rupture disk 116 defines a set of perforations or slits 116A that enables the rupture disk 116 to open or breach based on a predetermined amount of kinetic energy exerted on the rupture disk 116 generated by a propellant 118 of squib 100. Prior to operably engaging the rupture disk 116 with the housing 110, propellant 118 is loaded into the main passageway 110F for generating the predetermined amount of kinetic energy or force inside of the canister 22; such generation of the predetermined amount of kinetic energy ejects the payload 24 and the smart piston 90 from the canister 22 during a military operation. In one instance, propellant may be a combination of primer and HMX for generating a predetermined amount of kinetic energy or force inside of the canister 22.

Squib 100 also includes a support member 120 that operably engages with the housing 110 inside of main passageway 110F. As best seen in FIG. 14, the support member 120 includes an annular conductor 122 that operably engages with the interior wall 110E of the housing 110, particularly the second interior portion 110L, and the front surface 112A of the internal extension 112. Annular conductor 122 includes a first end 122A that faces forwardly towards the first end 110A, a second end 122B that faces rearward towards the internal extension 112 and operably engages with the front surface 112A of the internal extension 112, and an axis defined therebetween. Annular conductor 122 also includes an outer wall 122C that extends between the first end 122A and the second end 122B and operably engages with the interior wall 110E, particularly the second interior portion 110L. Annular conductor 122 also includes an interior wall 122D that extends between the first end 122A and the second end 122B and faces in an opposing direction relative to the outer wall 122C. Interior wall 122D also includes defines a hole 122F that extends entirely through the annular conductor 122 between the first end 122A and the second end 122B; such use and purpose of the hole 122F is discussed in greater detail below.

The support member 120 also includes an insulated seal 124 that operably engages with the annular conductor 122. As best seen in FIG. 14, insulated seal 124 includes a first end 124A that faces forwardly towards the first end 110A, a second end 124B that faces rearward towards the internal extension 112, and an axis defined therebetween. Insulated seal 124 also includes an outer wall 124C that extends between the first end 124A and the second end 124B and operably engages with the interior wall 122D inside of the hole 122E.

Still referring to insulated seal 124, insulated seal 124 also includes a first interior wall 124D that extends between the first end 124A and the second end 124B and faces in an opposing direction relative to the outer wall 124C. First interior wall 124D also includes defines a first opening 124E that extends entirely through the insulated seal 124 between the first end 122A and the second end 122B; such use and purpose of the first opening 124E is discussed in greater detail below. Insulated seal 124 also includes a second interior wall 124F that extends between the first end 124A and the second end 124B and faces in an opposing direction relative to the outer wall 124C. Second interior wall 124F also includes defines a second opening 124G that extends entirely through the insulated seal 124 between the first end 122A and the second end 122B; such use and purpose of the second opening 124G is discussed in greater detail below. In the present disclosure, the first opening 124E and the second opening 124G are spaced apart and separate from one another due to the first interior wall 124D and the second interior wall 124F being spaced apart and separate from one another.

In the present disclosure, each of the housing 110 and the annular conductor 122 is made from a first or conductive material that enables the annular conductor 122 to output and/or transmit at least one electrical signal to the housing 110 during a countermeasure operation. Since housing 110 is also made from a similar conductive material, the housing 110 and the annular conductor 122 may transmit at least one electrical signal (sent from a firing pin of the set of firing pins mechanisms 14B) to the second electrical connector 33B and the third electrical signal 33C for providing electrical power to the components and parts of the payload 24.

In the present disclosure, the insulated seal 124 is made from a second or insulated material that prevents one or more electrical signals (sent from a firing pin of the set of firing pins mechanisms 14B) from escaping the support member 120 during a countermeasure operation. As described in greater detail below, the insulated seal 124 also electrically isolates and separates a first electrical network of squib 100 and a second electrical network of squib 100 from one another when the squib 100 is igniting propellant 118 loaded inside of the squib 100 and/or communicate with a processor of the countermeasure expendable 20 in response to receiving at least one electrical signal at a fire pin contact of squib 100.

Support member 120 also includes a conduit or feed-through member 126 that operably engages with the insulated seal 124. As best seen in FIG. 14, a portion of the conduit 126 operably engages with the second interior wall 124F inside of the second opening 124G. Conduit 126 also includes a first end 126A that operably engages with the second interior wall 124F inside of the second opening 124G, a second end 126B longitudinally opposite to the first end 126A and is spaced apart from the insulted seal 124, and a passageway 126C defined between the first end 126A and the second end 126B. As described in greater detail below, conduit 126 enables a communication wire of an electrical assembly of squib 100 to pass through the insulated member 124 by the passageway 126C.

Squib 100 also includes an electrical assembly that operably engages with the support member 120. In the present disclosure, the electrical assembly includes at least one or first electrical network 140 that is configured to ignite the propellant 118 loaded inside of the squib 100 in response to receiving at least one electrical signal having a first voltage at fire pin contact of the squib 100. The components and parts of the first electrical network 140 are now described in greater detail below.

First electrical network 140 includes a conductor pin 142 that operably engages with the support member 120, particularly with the insulated seal 124. As best seen in FIG. 14, the conductor pin 142 includes a first or input end 142A that positioned external to the first opening 124E of the insulated seal 124. Conductor pin 142 also includes a second or output end 142B that is positioned at the second end 124B of the insulated seal 124 and is longitudinally opposite to the input end 124A. Conductor pin 142 also defines a recess 142C that extends longitudinally into the conductor pin 142 from the input end 142A; such use and purpose of the recess 142C is discussed in greater detail below. In the present disclosure, the conductor pin 142 is made from any suitable conductive material that enables the conductor pin 142 to output and/or transmit at least one electrical signal from the input end 142A to the output end 142B.

Figure 14A:
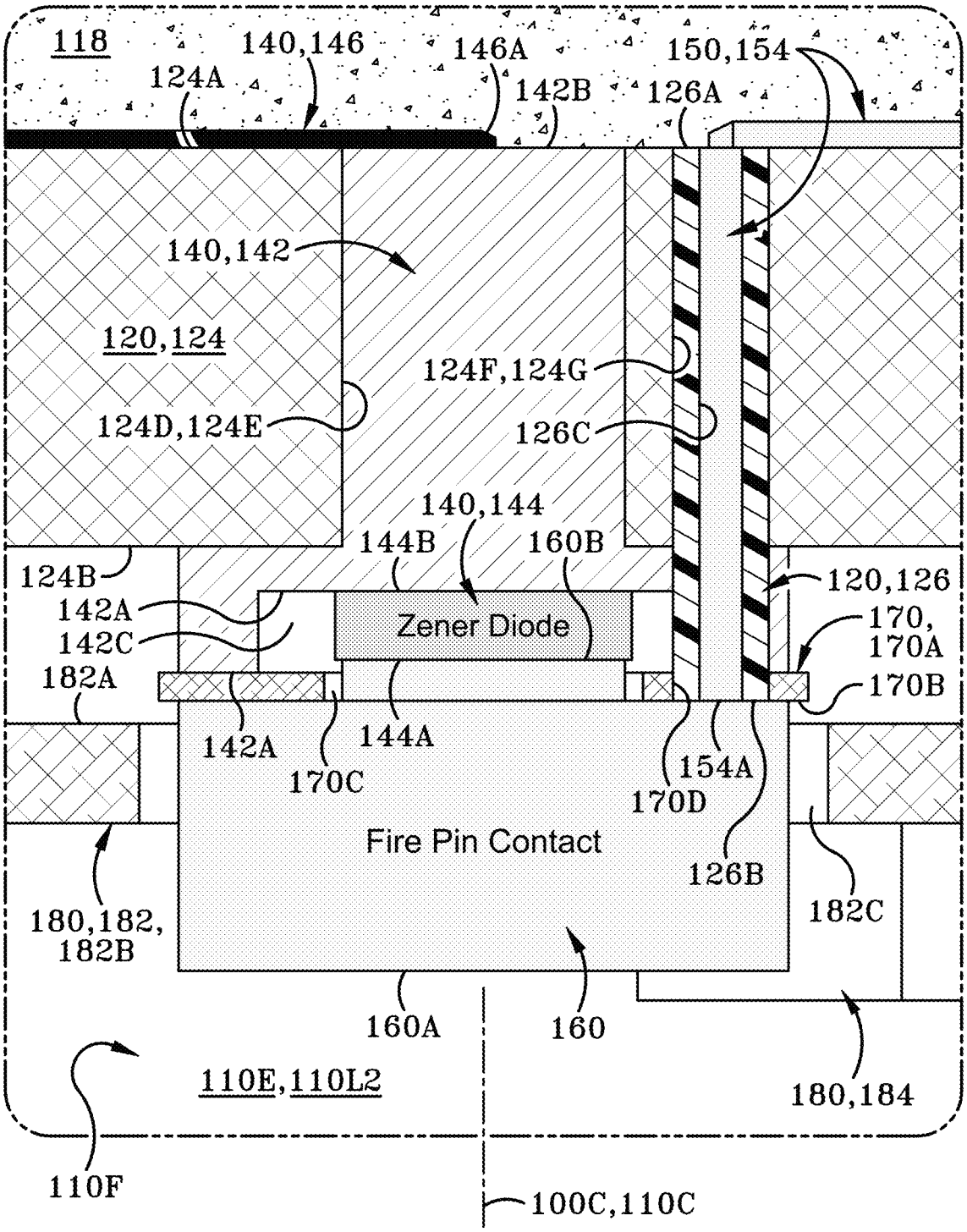
FIG. 14A (FIG. 14A) is an enlargement of the highlighted region shown in FIG. 14.
Figure 15:
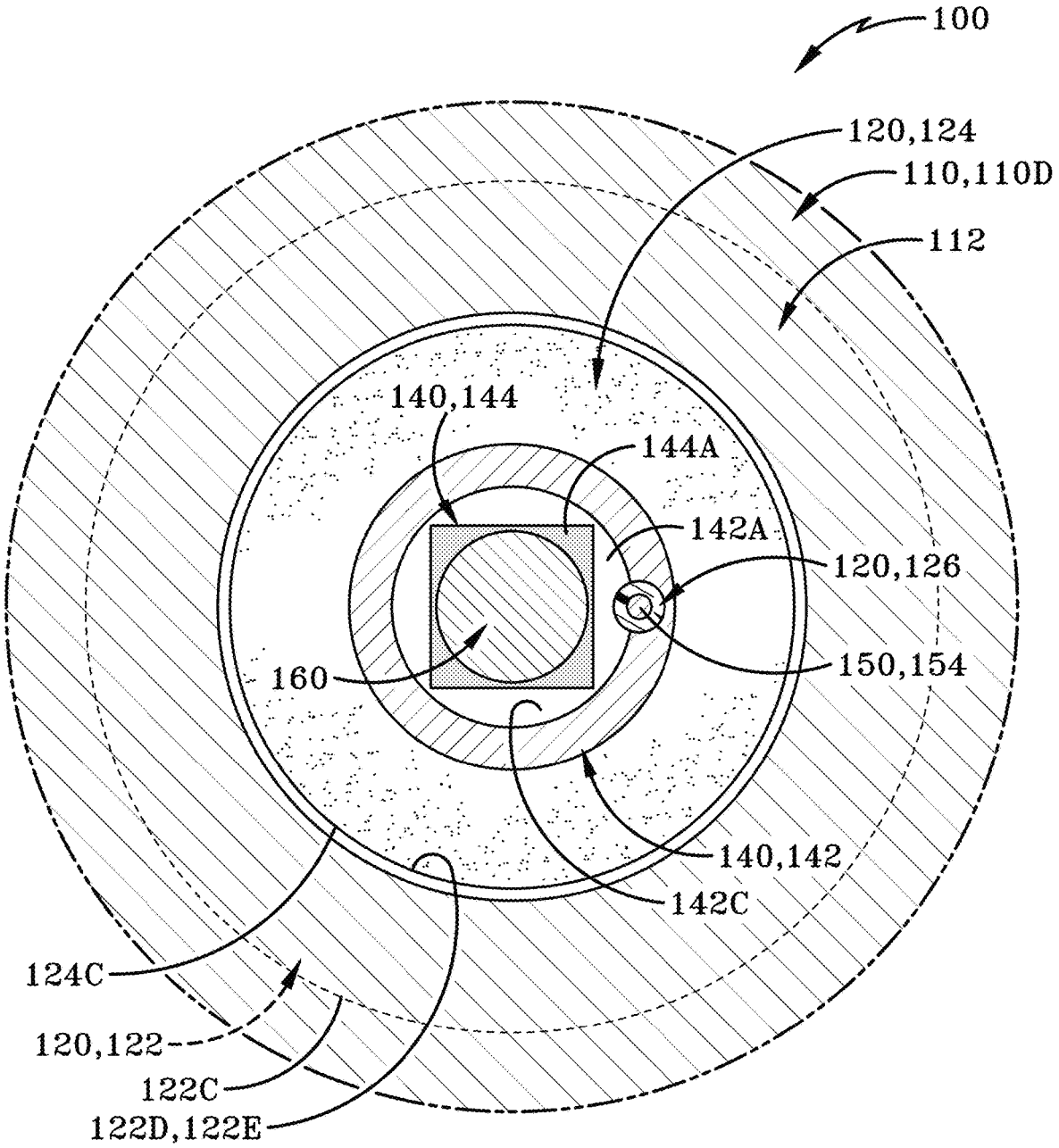
FIG. 15 (FIG. 15) is a cross-sectional view of the SSCI squib taken along line 15-15 in FIG. 14.
Figure 16:
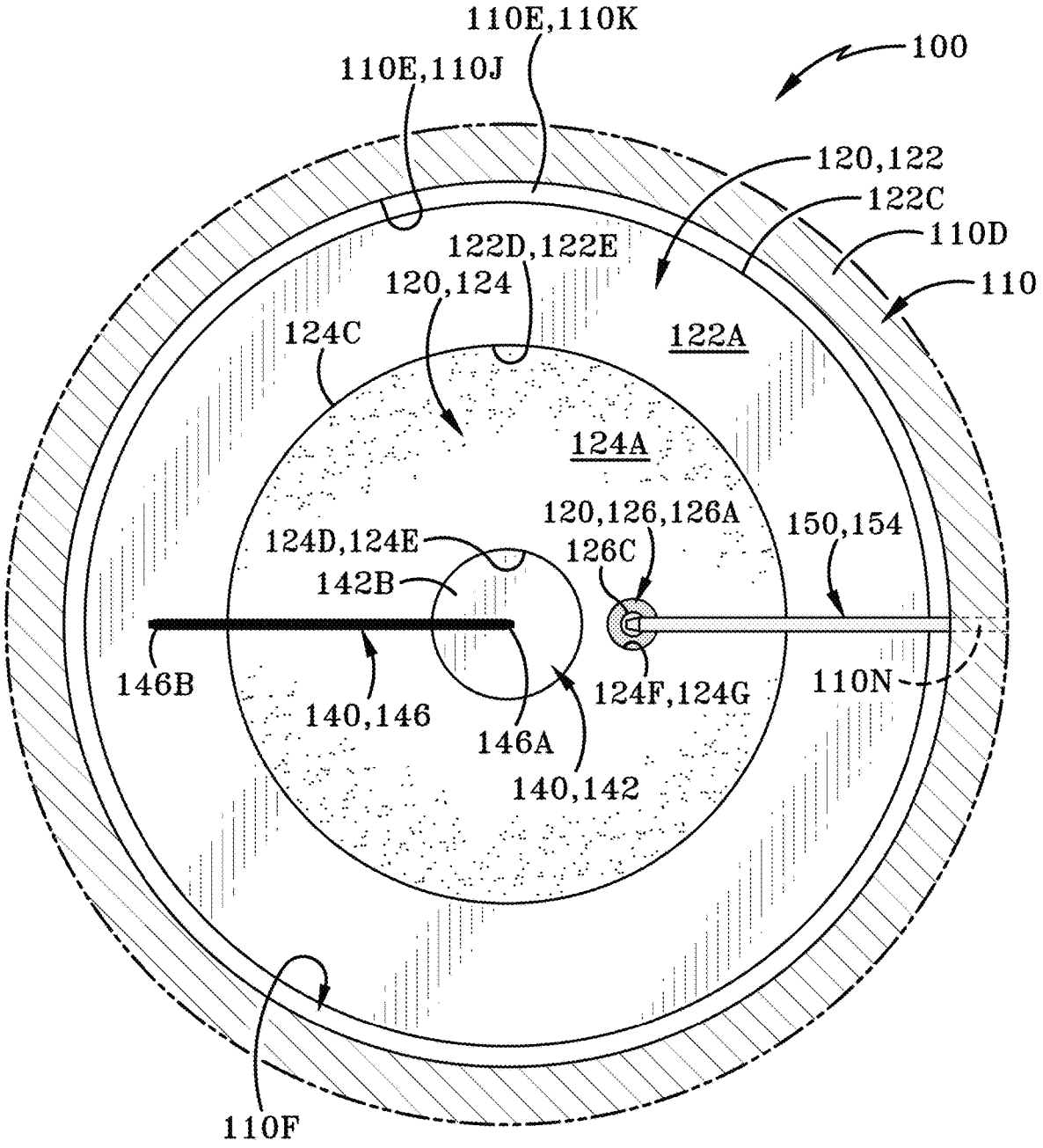
FIG. 16 (FIG. 16) is a cross-sectional view of the SSCI squib taken along line 16-16 in FIG. 14.

First electrical network 140 also includes at least one Zener diode 144 that operably engages with the conductor pin 142. In the present disclosure, and as best seen in FIG. 14A, a single Zener diode 144 operably engages with the input end 142A of the conductor pin 142 inside of the recess 142C and is axially aligned with the conductor pin 142. Still referring to FIG. 14A, Zener diode 144 includes a first or input end 144A facing rearward away from the input end 142A, and a second or output end 144B facing forwardly at and operably engaging with the input end 142A inside of recess 142C. It should be understood that Zener diode 144 is configured with a predetermined voltage threshold for enabling at least one electrical signal to break down and pass through the Zener diode 144 for ignition and electrical powering purposes. Such operation of Zener diode 144 is discussed in greater detail below.

First electrical network 140 also includes a bridge wire 146 that operably engages with the conductor pin 142. As best seen in FIG. 14, the bridge wire 146 includes a first or input end 146A that operably engages with the output end 142B of the conductor pin 142, and a second or output end 146B that operably engages with the first end 122A of the annular conductor 122. Such connection between the annular conductor 122 and the conductor pin 142 by the bridge wire 146 provides a continuous electrical connection between the housing 110 and the first electrical network 140 so that at least one electrical signal (sent from a firing pin of the set of firing pins mechanisms 14B) may be transmitted to the second electrical connector 33B and the third electrical signal 33C for enabling power to the components and parts of the payload 24. Such connection of the conductor pin 142 and the bridge wire 146 also enables ignition and/or discharge of propellant 118 in response to receiving at least one electrical signal from a firing pin of the set of firing pins mechanisms 14B.

Electrical assembly of squib 100 also includes at least another or second electrical network 150. In the present disclosure, the second electrical network 150 is configured to communicate with a processor of the countermeasure expendable 20 in response to receiving at least another electrical signal with a second voltage at a fire pin contact. It should be understood that the second electrical network 150 is also isolated and separated from the first electrical network 140 such that the first electrical network 140 and the second electrical network 150 are free from communicate with one another during countermeasure operations. The components and parts of the second electrical network 150 are now described in greater detail below.

Figure 20A:
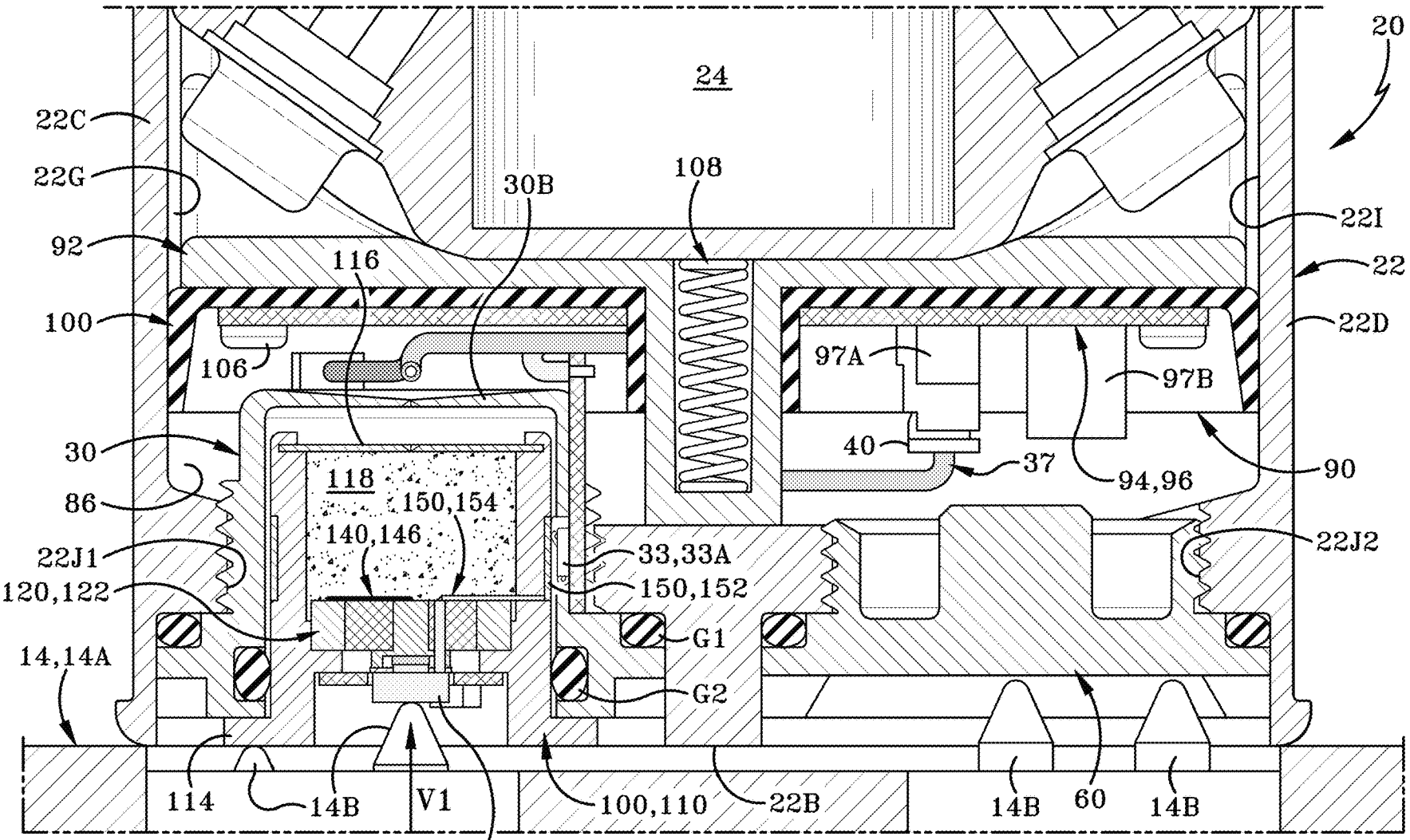
FIG. 20A (FIG. 20A) is an operational cross section view with the SSCI squib inserted into the IC cup, wherein a fire pin pulses the first electrical signal having the first voltage to communicate with the processor of the payload of the countermeasure expendable.
Figure 20B:
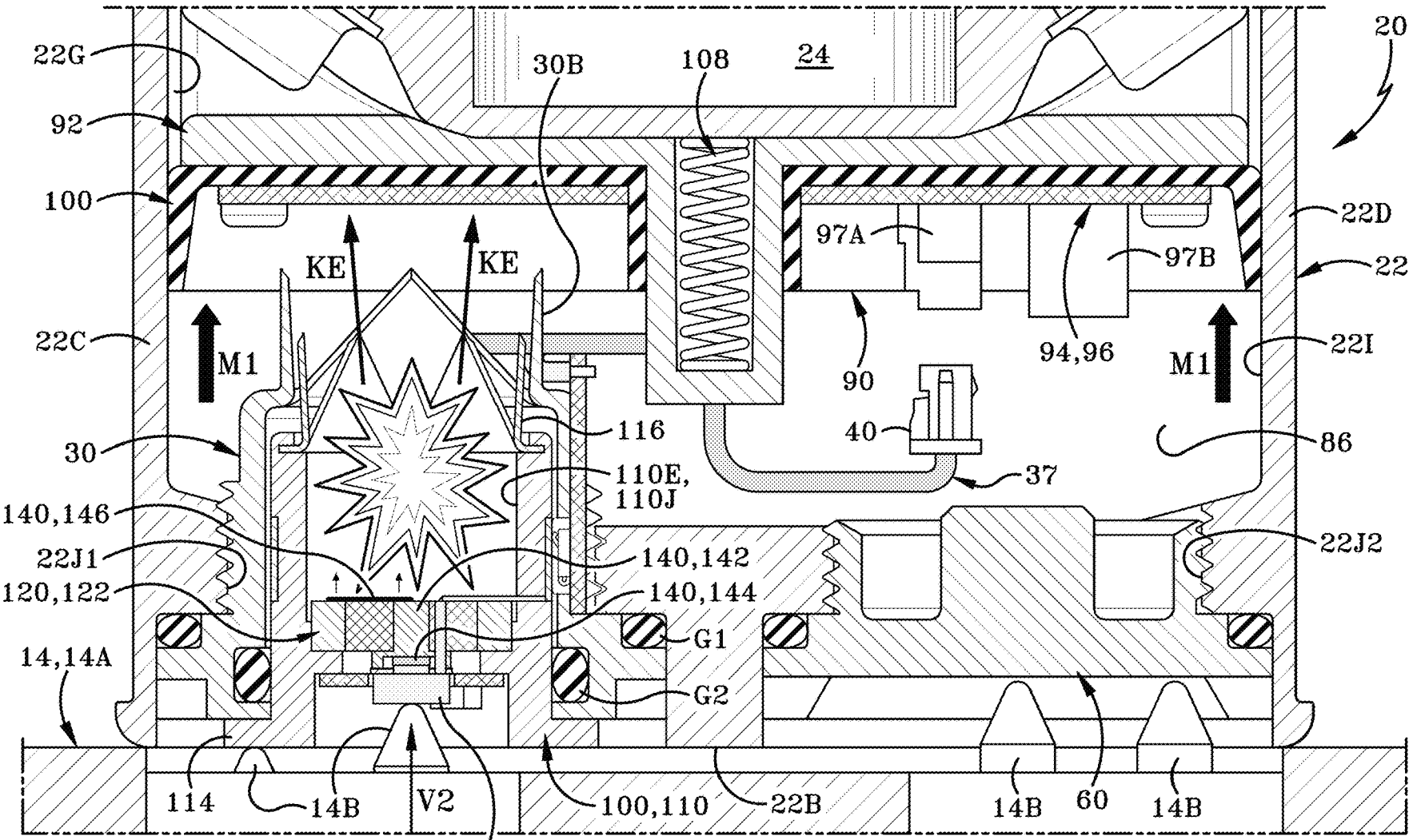
FIG. 20B (FIG. 20B) is an operational cross section view with the SSCI squib inserted into the IC cup, wherein the fire pin pulses the second electrical signal having the second voltage to detonate the squib and to power the payload of the countermeasure expendable.

Second electrical network 150 includes a payload or annular interface 152. As best seen in FIG. 14, annular interface 152 operably engages with the exterior wall 110D of housing 110 inside of the notch 110M while being located external to the main passageway 110F. Annular interface 152 includes a first or input surface 152A that faces inwardly towards the notch 110M, and a second or output surface 152B that faces outwardly away from the notch 110M. Upon assembly of countermeasure expendable 20, the annular interface 152 is configured to contact the first electrical connector 33A of the IC cup 30 for enabling logic communication between the squib 100 and the processor of the countermeasure expendable 20 (see FIGS. 19-20A).

Second electrical network 150 also includes a communication wire 154. As best seen in FIG. 14, the communication wire 154 is fed through the conduit 126 of support member 120 and the side passageway 110N of housing 110 to enable the communication wire 154 to be electrically connected with the annular interface 152. The communication wire 154 includes a first or input surface 152A that is positioned internal of the housing 110, and a second or output surface 154B that is positioned inside of the side passageway 110N and operably engages with the input surface 152A of the annular interface 152. Such connection between the annular interface 152 and the communication wire 154 provides a continuous electrical connection so that at least another electrical signal (sent from a firing pin of the set of firing pins mechanisms 14B) may be transmitted to the first electrical connector 33A for enabling logic communication between the squib 100 and the processor of the countermeasure expendable 20.

Squib 100 also includes a fire pin contact 160 that operably engages with the electrical assembly. More particularly, the fire pin contact 160 operably engages with the first electrical network 140 and the second electrical network 150 for transmitting at least one or more electrical signals from a firing pin mechanism of the set of firing pin mechanisms 14B and the payload 24. As best seen in FIG. 14A, firing pin contact 160 includes an input end 160A that is adapted to engage with a firing pin mechanism of the set of firing pin mechanisms 14B (see FIGS. 18A-18B and FIGS. 20A-20B). Still referring to FIG. 14A, firing pin contact 160 also includes an output end 160B that operably engages with the first electrical network 140 and the second electrical network 150. More particularly, the output end 160B of the fire pin contact 160 operably engages with the input end 144A of the Zener diode 144 and the input end 154A of the communication wire 154 to enable electrical communication between the Zener diode 144 and the fire pin contact 160 and between the communication wire 154 and the fire pin contact 160. Such transmissions of at least or more one electrical signals through the fire pin contact 160 are discussed in greater detail below.

Squib 100 also includes an insulator 170 that operably engages with the electrical assembly and the fire pin contact 160. More particularly, the insulator 170 operably engages with the input end 142A of the conductor pin 142, the input end 154A of the communication wire 154, and the output end 160B of the fire pin contact 160. As best seen in FIG. 14A, the insulator 170 includes a first end 170A that operably engages with the output end 160B of the fire pin contact 160, and a second end 170B opposite to the first end 170A and operably engages with the input end 142A of the conductor pin 142. Insulator 170 also defines a first aperture 170C that extends entirely through the insulator 170 such that the first end 170A and the second end 170B are in fluid communication with one another at the first aperture 170C. In the present disclosure, a portion of the fire pin contact 160 extends through the first aperture 170C to enable electrical connection between the Zener diode 144 and the fire pin contact 160. Insulator 170 also defines a second aperture 170D that extends entirely through the insulator 170 such that the first end 170A and the second end 170B are in fluid communication with one another at the second aperture 170D. In the present disclosure, a portion of the conduit 126 and a portion of the communication wire 154 extend through the second aperture 170D to enable electrical connection between the communication wire 154 and the fire pin contact 160.

In the present disclosure, the insulator 170 is made from the second or insulated material similar to the insulated seal 124 mentioned previously. In operation, the insulator 170 is configured to prevent one or more electrical signals (sent from a firing pin of the set of firing pins mechanisms 14B) from escaping the fire pin contact 160 during operation. With such configuration, the insulator 170 maintains the one or more electrical signals between the first electrical network 140 and the second electrical network 150 such that the one or more electrical signals do not escape the fire pin contact 160.

Squib 100 also includes a surge suppression assembly 180 that operably engages with the fire pin contact 160. In the present disclosure, surge suppression assembly 180 is configured to suppress transients or temporary spikes or surges in voltage received at and transmitted by the fire pin contact 160. Such components and parts of the surge suppression assembly 180 are discussed in greater detail below.

Surge suppression assembly 180 includes a circuit board 182 that operably engages with the fire pin contact 160. As best seen in FIG. 14, circuit board 182 includes a first end 182A facing rearward towards the second end 110B of the housing 110, a second end 182B opposite to the first end 182A and the second end 182B operably engages with the rear surface 112B of the internal extension 112, and an opening 182C defined between the first end 182A and the second end 182B for receiving a portion of the fire pin contact 160. Circuit board 182 is configured to electrically connect with at least one transient voltage suppressors (TVS) 184 to suppress transients or temporary spikes or surges in voltage received at and transmitted by the fire pin contact 160. In the present disclosure, surge suppression assembly 180 includes two TVSs 184 to suppress transients or temporary spikes or surges in voltage received at and transmitted by the fire pin contact 160. It should be appreciated that TVSs 184 mentioned herein may be any suitable and commercially-available TVSs for suppressing transients or temporary spikes or surges in voltage received at and transmitted by the fire pin contact 160. In one exemplary embodiment, the surge suppression assembly 180 may be removed or omitted from squib 100 if desired.

Having now described the parts and components of squib 100, an electrical schematic of squib 100 is discussed in greater detail below.

Figure 17:
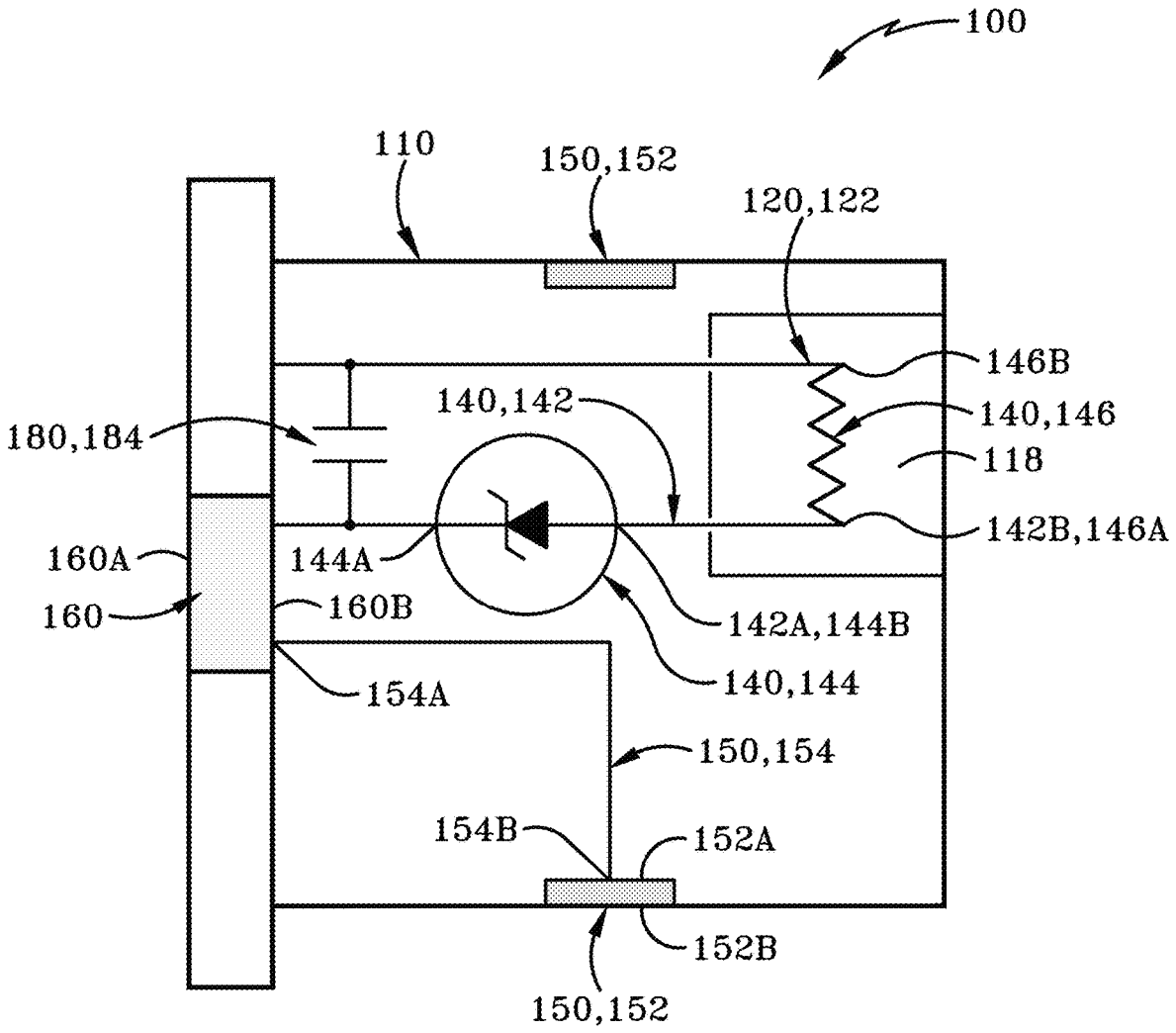
FIG. 17 (FIG. 17) is an electrical schematic of the SSCI squib.

In the present disclosure, the first electrical network 140 electrically connects with the fire pin contact 160. As best seen in FIG. 17, the output end 160B of the fire pin contact 160 electrically connects with the input end 144A of the Zener diode 144 such that the Zener diode 144 and the fire pin contact 160 are in series with one another. In the first electrical network 140, the output end 144B of the Zener diode 144 electrically connects to the input end 146A of the bridge wire 146, via the conductor pin 142, such that the Zener diode 144 and the bridge wire 146 are in series with one another. In the first electrical network 140, the output end 146B of the bridge wire 146 also electrically connects with the housing 110 to enable shorting and grounding of the first electrical network 140. With such electrical connection of the housing 110, the first electrical network 140, and the fire pin contact 160, one or more electrical signals may be transmitted to the second electrical connector 33B of the IC cup 30 and the third electrical connector 33C to power the payload 24 to an operating state as well as igniting propellant 118 by the bridge wire 146 during a countermeasure operation.

Still referring to FIG. 17, TVS 184 (illustrated as a capacitor element) also electrically connects with the first electrical network 140 and the fire pin contact 160 such that the TVS 184 is in parallel with the first electrical network 140 and the fire pin contact 160. Such placement of the TVS 184 enables TVS 184 to capture and suppress transients or surges or spikes of voltage at the fire pin contact 160 before such transients or surges or spikes of voltage travels downstream towards the Zener diode 144.

Still referring to FIG. 17, the second electrical network 150 also electrically connects with the fire pin contact 160. As best seen in FIG. 17, the output end 160B of the fire pin contact 160 electrically connects with the input end 154A of the communication wire 154 such that the communication wire 154 and the fire pin contact 160 are in series with one another. In the second electrical network 150, the communication wire 154 also electrically connects to the input surface 152A of the annular interface 152 such that the annular interface 152 and the communication wire 154 are in series with one another. With such electrical connection between the second electrical network 150 and the fire pin contact 160, one or more electrical signals may be transmitted to the first electrical connector 33A of the IC cup 30 to enable logical communication with the payload 24 of the countermeasure expendable 20, particularly the processor of the countermeasure expendable 20.

Having now described the electrical schematics of squib 100, methods of using squib 100 during countermeasure operations are described in greater detail below.

Prior to using squib 100, squib 100 is loaded into IC cup 30 of a countermeasure payload of the set of countermeasure payloads 20. As best seen in FIG. 19, the squib 100 is loaded into the cavity 30A of IC cup 30 until the set of electrical connectors 33 contacts the squib 100 and the lip 114 of the housing 110 is stopped by the IC cup 30. The squib 100 is also loaded into the cavity 30A of IC cup 30 until the first electrical connector 33A of IC cup 30 contacts and engages with the annular interface 152 (see FIG. 19). Such connection between the first electrical connector 33A and the annular interface 152 enables communication between the squib 100 and the processor of the payload 24. The squib 100 is also loaded into the cavity 30A of IC cup 30 until the second electrical connector 33B and the third electrical connector 33C of IC cup 30 contacts and engages with the exterior wall 110D of the housing 110. Such connection between the second electrical connector 33B and the third electrical connector 33C enables the first electrical network 140 to be shorted and grounded to provide electrical power to the payload 24.

Once each squib 100 is loaded, each countermeasure expendable of the set of countermeasure expendables 20 may then be loaded into the magazine 16. The magazine 16 may then be loaded into the dispenser 12A where a firing pin mechanism of the set of firing pin mechanism 14B contacts a squib 100 of each countermeasure expendable of the set of countermeasure expendables 20 (see FIGS. 18A-18B and 20A-20B). Once engaged, the connection between a firing pin mechanism of the set of firing pin mechanism 14B and a squib 100 may enable the sequencer 18 (and other external devices) to communicate with a processor of the payload 24 after sending at least one signal with at least one voltage to the squib 100. Once engaged, the connection between a firing pin mechanism of the set of firing pin mechanism 14B and a squib 100 may also enable the sequencer 18 (and other external devices) to ignite the propellant 118 inside of the squib 100 for firing and ejecting the payload 24 from the canister 22 after sending at least another signal with at least another voltage to the squib 100. Such operations of communication and ignition are discussed in greater detail below.

Figure 18A:
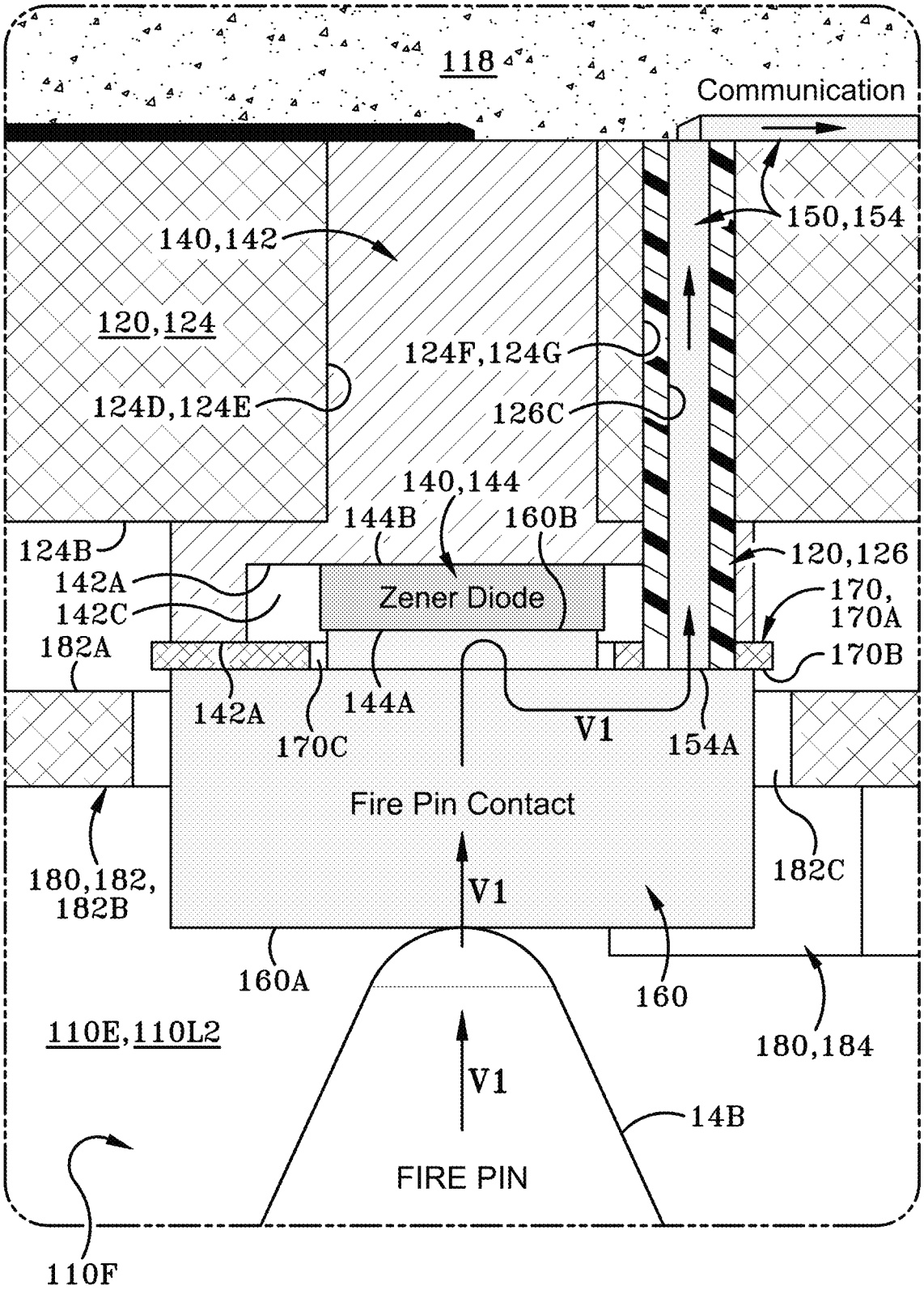
FIG. 18A (FIG. 18A) is an operational view of the SSCI squib, wherein a fire pin pulses a first electrical signal having a first voltage to communicate with a processor of a payload of the countermeasure expendable.

In one instance, sequencer 18 (and other external devices) may output or pulse a first electrical signal having a first voltage to a firing pin mechanism of the set of firing pin mechanisms 14B; the first electrical signal having the first voltage is denoted by arrows labeled "V1" in FIG. 18A. In this instance, first electrical signal V1 is a communication signal sent from the sequencer 18 to communicate with the processor of the payload. Once the first electrical signal V1 is outputted from the firing pin mechanism 14B, the first electrical signal V1 is received at the input end 160A of fire pin contact 160. The fire pin contact 160 is then configured to transmit the first electrical signal V1 through the fire pin contact 160 and output the first electrical signal V1 to the Zener diode 144. More particularly, fire pin contact 160 is configured to transmit the first electrical signal V1 through the fire pin contact 160 and output the first electrical signal V1 from the output end 160B to input end 144A of the Zener diode 144.

Once the first electrical signal V1 is received at the Zener diode 144, Zener diode 144 is configured to allow the first electrical signal V1 to pass through towards the bridge wire 146 if the predetermined voltage threshold of the Zener diode 144 is reached and breaks down the Zener diode 144. Since the first electrical signal V1 is a communication signal, the first voltage of the first electrical signal V1 is shown having a voltage less than the predetermined voltage threshold of the Zener diode. In one exemplary embodiment, the first voltage of the first electrical signal has a voltage less than the voltage threshold of 6.2 volts of the Zener diode 144. In this instance, the first electrical signal V1 is then rerouted to the communication wire 154 of the second electrical network 150, which is the nearest electrical connection from the Zener diode 144.

Still referring to FIG. 18A, the first electrical signal V1 having the first voltage is then transmitted from the fire pin contact 160 to the communication wire 154. More particularly, the first electrical signal V1 having the first voltage is transmitted from the output end 160B of the fire pin contact 160 to the input end 154A of the communication wire 154. The communication wire 154 is then configured to transmit the first electrical signal V1 from the input end 154A to the output end 154B until the first electrical signal reaches the annular interface 152.

While not illustrated herein, the first electrical signal V1 is outputted from the output end 154B of the communication wire 154 to the input surface 152A of the annular interface 152. The annular interface 152 is configured to then output the first electrical signal V1 from the output surface 152B to the first electrical connector 33A of the set of electrical connectors 33 of the IC cup 30. Once received at the first electrical connector 33A, the first electrical signal V1 would then be transmitted through the first carrier board 34A to wire 37A via pin 38A (see FIG. 19). The wire 37A is then configured to output the first electrical signal V1 to a first electrical port 97A of the smart piston 90 which then, in turn, outputs the first electrical signal V1 to the processor of payload 24. Such electrical path previously described above may be used by sequencer 18 (or other external devices) to logically communicate with the processor of the payload 24 or other logic devices provided in payload 24.

Figure 18B:
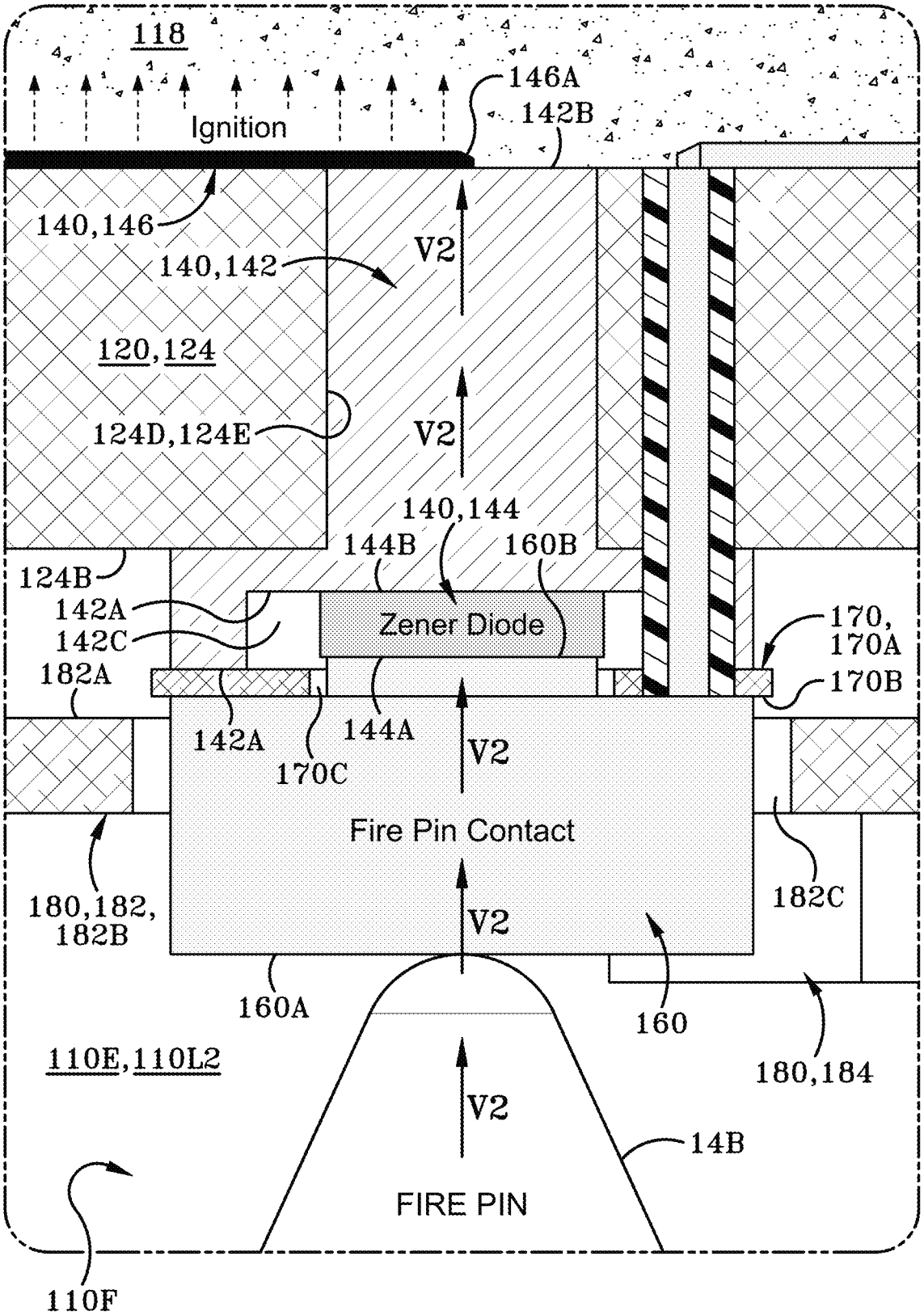
FIG. 18B (FIG. 18B) is another operational view similar to FIG. 18A, but the fire pin pulses a second electrical signal having a second voltage to detonate the squib and to power the payload of the countermeasure expendable.

In another instance, sequencer 18 (and other external devices) may output or pulse a second electrical signal having a second voltage to a firing pin mechanism of the set of firing pin mechanisms 14B that is greater than the first voltage of the first electrical signal; the second electrical signal having the second voltage is denoted by arrows labeled "V2" in FIG. 18B. In this instance, second electrical signal V2 is an ignition and power electrical signal sent from the sequencer 18 to ignite the propellant 118 and power on the payload 24 for countermeasure operations. Once the second electrical signal V2 is outputted from the firing pin mechanism 14B, the second electrical signal V2 is received at the input end 160A of fire pin contact 160. The fire pin contact 160 is then configured to transmit the second electrical signal V2 through the fire pin contact 160 and output the second electrical signal V2 to the Zener diode 144. More particularly, fire pin contact 160 is configured to transmit the second electrical signal V2 through the fire pin contact 160 and output the second electrical signal V2 from the output end 160B to input end 144A of the Zener diode 144.

Once the second electrical signal V2 is received at the Zener diode 144, Zener diode 144 is configured to allow the second electrical signal to pass through towards the bridge wire 146 if the predetermined voltage threshold of the Zener diode 144 is reached and breaks down Zener diode 144. Since the second electrical signal V2 is an ignition and power electrical signal, the second voltage of the second electrical signal V2 is shown having a voltage greater than the predetermined voltage threshold of the Zener diode. In one exemplary embodiment, the second voltage of the second electrical signal has a voltage greater than the voltage threshold of 6.2 volts of the Zener diode 144. In this instance, the second electrical signal V2 then passes through the Zener diode 144 and is outputted from the output end 144B of the Zener diode 144.

Still referring to FIG. 18B, the second electrical signal V2 is then outputted from the Zener diode 144 to the input end 142A of the conductor pin 142. The conductor pin 142 is configured to transmit the second electrical signal V2 from the input end 142A to the output end 142B. As the second electrical signal V2 reaches the output end 142B, the conductor pin 142 then outputs the second electrical signal V2 to the bridge wire 156. More particularly, the conductor pin 142 outputs the second electrical signal V2 from the output end 142B to input end 156A of the bridge wire 156. As the second electrical signal V2 transmits from the input end 156A to the output end 156B, the bridge wire 156 simultaneously generates thermal energy to induce ignition of the propellant 118 of the squib 100 and transmits electrical energy to the IC cup 30 to power the payload 24 to an operating state.

With respect to ignition, the propellant 118 creates kinetic energy "KE" that is directed at the rupture disk 116 causing the rupture disk 116 to open and allow the kinetic energy to escape at the second end 110B of the housing 110. The kinetic energy generated from the propellant 118 also opens the end wall 30B of the IC cup 30 and allows the kinetic energy to escape through the IC cup 30. The kinetic energy is then directed towards the smart piston 90 into a combustion chamber 86 defined between the impulse cartridge cup 30 and the smart piston 90. The kinetic energy is also maintained between the impulse cartridge cup 30 and the smart piston 90 to ensure that a substantial amount of the kinetic energy is used to eject the payload 24 and the smart piston 90 from the canister 22. The kinetic energy generated by the squib then collectively moves the payload 24 and the smart piston 90 through the canister 22 towards the front wall 22A away from the rear wall 22B, as indicated by arrows M1. First electrical port 97A enables a set of electrical connections to electrically connect the impulse cartridge cup 30 with the electronic system 94. Such first electrical port 97A enables the impulse cartridge cup 30 and the payload 24 to logically communicate with one another by passing through the smart piston 90. A second electrical port 97B electrically connects with an electrical circuit board (ECB) 94 of smart piston 90. Second electrical port 97B enables an external computer or testing unit to electrically connect with electronic system 94 for testing purposes. Such second electrical port 97B enables a user of countermeasure expendable 20 to communicate and interface with the processing unit of the payload 24 for various testing operations. The common connector 40 is disconnected from its connection with port 97A in response to the detonation of squib.

While not illustrated herein, the second electrical signal V2 is outputted from the output end 146B of the bridge wire 146 to annular conductor 122, particularly the first end 122A of the annular conductor 122. Based on the structural arrangement of the housing 110 and the annular conductor 122, the annular conductor 122 transmits the second electrical signal V2 to the housing 110 due to the housing 110 and the annular conductor 122 being made of conductive material. Once received, the housing 110 then transmits the second electrical signal V2 to the IC cup 30 for powering on the payload 24.

Once the second electrical signal V2 is outputted from the housing 110, the second electrical signal V2 is sent to the second electrical connector 33B and the third electrical connection 33C of the IC cup 30. Once received at each of the second electrical connector 33B and the third electrical connector 33C, the second electrical signal V2 would then be transmitted through the second carrier board 34B to wire 37B via pin 38B and the third carrier board 34C to wire 37C via pin 38C (see FIG. 19). The wires 37B, 37C are then configured to output the second electrical signal V2 to the first electrical port 97A of the smart piston 90 which then, in turn, outputs the second electrical signal V2 to payload 24. Such electrical path previously described above may be used by sequencer 18 (or other external devices) to ignite the propellant 118 of squib 100 and to power on the processor of the payload 24 and other electrical devices provided in payload 24.

Figure 21:
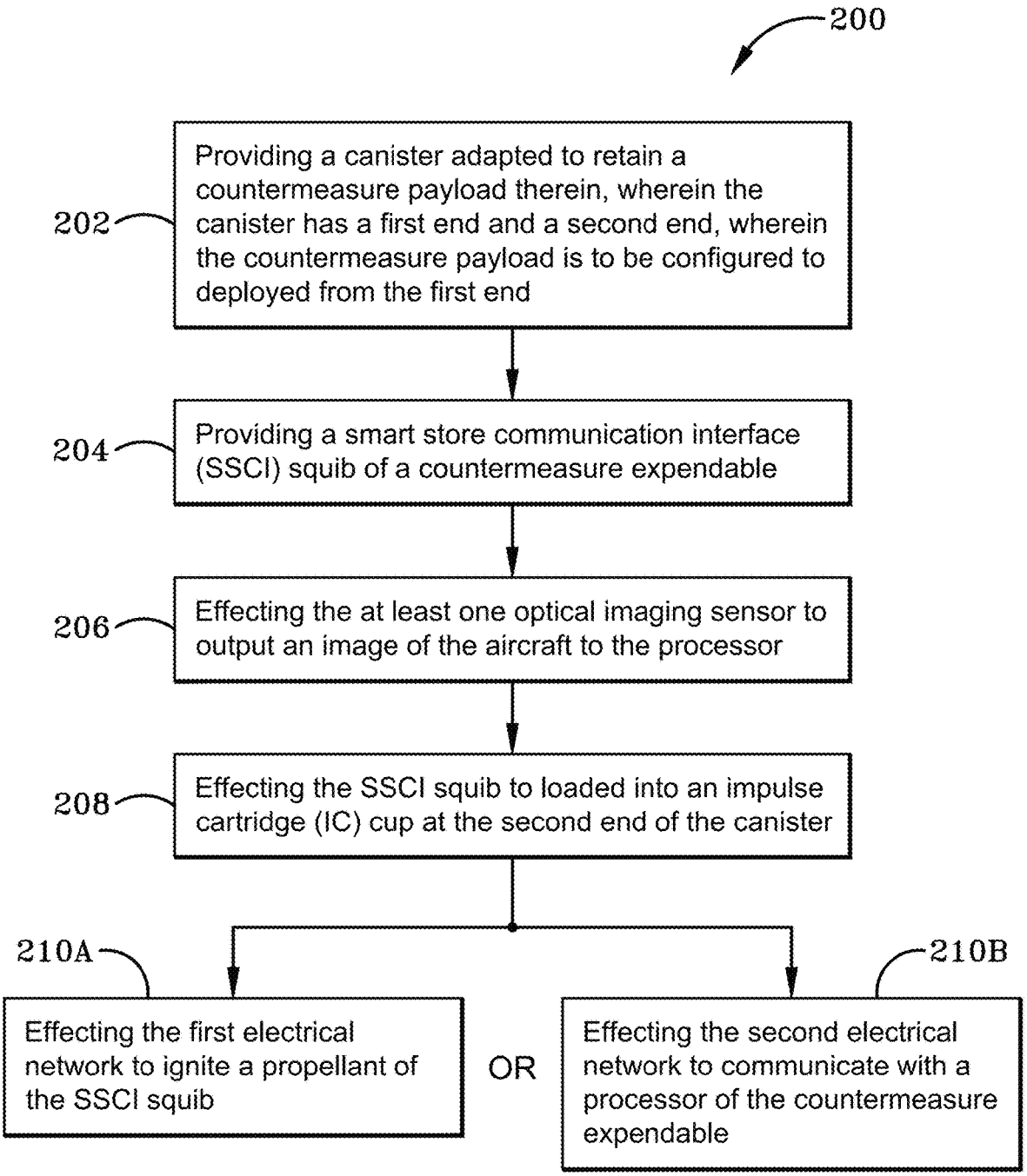
FIG. 21 (FIG. 21) is an exemplary method flowchart.

FIG. 21 is a method 200. An initial step 202 of method 200 includes providing a canister adapted to retain a countermeasure payload therein, wherein the canister has a first end and a second end, wherein the countermeasure payload is to be configured to deployed from the first end. Another step 204 of method 200 includes providing a smart store communication interface (SSCI) squib of a countermeasure expendable, the SSCI squib comprises: a housing defining a main passageway; a support member operably engaged with the housing inside of the main passageway; a first electrical network operably engaged with the support member; a second electrical network operably engaged with the support member and isolated from the first electrical network by the support member; and a fire pin contact operably engaged with the first electrical network and the second electrical network and positioned internal to the main passageway of the housing. Another step 206 of method 200 includes effecting the SSCI squib to loaded into an impulse cartridge (IC) cup at the second end of the canister. Method 200 also includes performing one of the following steps 210A, 210B in response to receiving at least one electrical signal at the fire pin contact: effecting the first electrical network to ignite a propellant of the SSCI squib; or effecting the second electrical network to communicate with a processor of the countermeasure expendable.

Additional or optional steps may be further included with method 200. Optional steps may further include that the step of effecting the SSCI squib to loaded into the IC cup further comprises: effecting an annular interface of the SSCI squib to a first electrical connector of a set of electrical connectors of the IC cup; and communicating with the processor of the countermeasure payload via the first electrical connector. Optional steps may further include that the step of effecting the second electrical network to communicate with the processor of the countermeasure expendable further comprises: effecting the at least one electrical signal having a first voltage to be sent to the fire pin contact; outputting the at least one electrical signal from the fire pin contact to a Zener diode of the first electrical network; and sending the at least one electrical signal to a communication wire of the second electrical network, wherein the first voltage of the at least one electrical signal is less than a predetermined voltage threshold of the Zener diode. Optional steps may further include that the step of effecting the SSCI squib to loaded into the IC cup further comprises: effecting a housing of the SSCI squib to contact a first electrical connector of the set of electrical connectors of the IC cup; effecting the housing of the SSCI squib to contact a second electrical connector of the set of electrical connectors of the IC cup; and enabling power of the processor of the countermeasure payload, via the first electrical connector and the second electrical connector, in response to the at least one electrical signal. Optional steps may further include that the step of effecting the first electrical network to ignite the propellant of the SSCI squib: effecting the at least one electrical signal having a second voltage to be sent to the fire pin contact; outputting the at least one electrical signal from the fire pin contact to a Zener diode of the first electrical network; and outputting the at least one electrical signal from the Zener diode to a bridge wire of the first electrical network, wherein the second voltage of the at least one electrical signal is greater than a predetermined voltage threshold of the Zener diode. Another optional step may further include suppressing at least one transient, via at least one transient voltage suppressor, at the fire pin contact.

Various inventive concepts may be embodied as one or more methods, of which an example has been provided. The acts performed as part of the method may be ordered in any suitable way. Accordingly, embodiments may be constructed in which acts are performed in an order different than illustrated, which may include performing some acts simultaneously, even though shown as sequential acts in illustrative embodiments.

While various inventive embodiments have been described and illustrated herein, those of ordinary skill in the art will readily envision a variety of other means and/or structures for performing the function and/or obtaining the results and/or one or more of the advantages described herein, and each of such variations and/or modifications is deemed to be within the scope of the inventive embodiments described herein. More generally, those skilled in the art will readily appreciate that all parameters, dimensions, materials, and configurations described herein are meant to be exemplary and that the actual parameters, dimensions, materials, and/or configurations will depend upon the specific application or applications for which the inventive teachings is/are used. Those skilled in the art will recognize, or be able to ascertain using no more than routine experimentation, many equivalents to the specific inventive embodiments described herein. It is, therefore, to be understood that the foregoing embodiments are presented by way of example only and that, within the scope of the appended claims and equivalents thereto, inventive embodiments may be practiced otherwise than as specifically described and claimed. Inventive embodiments of the present disclosure are directed to each individual feature, system, article, material, kit, and/or method described herein. In addition, any combination of two or more such features, systems, articles, materials, kits, and/or methods, if such features, systems, articles, materials, kits, and/or methods are not mutually inconsistent, is included within the inventive scope of the present disclosure.

The above-described embodiments can be implemented in any of numerous ways. For example, embodiments of technology disclosed herein may be implemented using hardware, software, or a combination thereof. When implemented in software, the software code or instructions can be executed on any suitable processor or collection of processors, whether provided in a single computer or distributed among multiple computers. Furthermore, the instructions or software code can be stored in at least one non-transitory computer readable storage medium.

Also, a computer or smartphone may be utilized to execute the software code or instructions via its processors may have one or more input and output devices. These devices can be used, among other things, to present a user interface. Examples of output devices that can be used to provide a user interface include printers or display screens for visual presentation of output and speakers or other sound generating devices for audible presentation of output. Examples of input devices that can be used for a user interface include keyboards, and pointing devices, such as mice, touch pads, and digitizing tablets. As another example, a computer may receive input information through speech recognition or in other audible format.

Such computers or smartphones may be interconnected by one or more networks in any suitable form, including a local area network or a wide area network, such as an enterprise network, and intelligent network (IN) or the Internet. Such networks may be based on any suitable technology and may operate according to any suitable protocol and may include wireless networks, wired networks or fiber optic networks.

The various methods or processes outlined herein may be coded as software/instructions that is executable on one or more processors that employ any one of a variety of operating systems or platforms. Additionally, such software may be written using any of a number of suitable programming languages and/or programming or scripting tools, and also may be compiled as executable machine language code or intermediate code that is executed on a framework or virtual machine.

In this respect, various inventive concepts may be embodied as a computer readable storage medium (or multiple computer readable storage media) (e.g., a computer memory, one or more floppy discs, compact discs, optical discs, magnetic tapes, flash memories, USB flash drives, SD cards, circuit configurations in Field Programmable Gate Arrays or other semiconductor devices, or other non-transitory medium or tangible computer storage medium) encoded with one or more programs that, when executed on one or more computers or other processors, perform methods that implement the various embodiments of the disclosure discussed above. The computer readable medium or media can be transportable, such that the program or programs stored thereon can be loaded onto one or more different computers or other processors to implement various aspects of the present disclosure as discussed above.

The terms "program" or "software" or "instructions" are used herein in a generic sense to refer to any type of computer code or set of computer-executable instructions that can be employed to program a computer or other processor to implement various aspects of embodiments as discussed above. Additionally, it should be appreciated that according to one aspect, one or more computer programs that when executed perform methods of the present disclosure need not reside on a single computer or processor, but may be distributed in a modular fashion amongst a number of different computers or processors to implement various aspects of the present disclosure.

Computer-executable instructions may be in many forms, such as program modules, executed by one or more computers or other devices. Generally, program modules include routines, programs, objects, components, data structures, etc. that perform particular tasks or implement particular abstract data types. Typically, the functionality of the program modules may be combined or distributed as desired in various embodiments. As such, one aspect or embodiment of the present disclosure may be a computer program product including least one non-transitory computer readable storage medium in operative communication with a processor, the storage medium having instructions stored thereon that, when executed by the processor, implement a method or process described herein, wherein the instructions comprise the steps to perform the method(s) or process(es) detailed herein.

Also, data structures may be stored in computer-readable media in any suitable form. For simplicity of illustration, data structures may be shown to have fields that are related through location in the data structure. Such relationships may likewise be achieved by assigning storage for the fields with locations in a computer-readable medium that convey relationship between the fields. However, any suitable mechanism may be used to establish a relationship between information in fields of a data structure, including through the use of pointers, tags or other mechanisms that establish relationship between data elements.

All definitions, as defined and used herein, should be understood to control over dictionary definitions, definitions in documents incorporated by reference, and/or ordinary meanings of the defined terms.

"Logic", as used herein, includes but is not limited to hardware, firmware, software, and/or combinations of each to perform a function(s) or an action(s), and/or to cause a function or action from another logic, method, and/or system. For example, based on a desired application or needs, logic may include a software controlled microprocessor, discrete logic like a processor (e.g., microprocessor), an application specific integrated circuit (ASIC), a programmed logic device, a memory device containing instructions, an electric device having a memory, or the like. Logic may include one or more gates, combinations of gates, or other circuit components. Logic may also be fully embodied as software. Where multiple logics are described, it may be possible to incorporate the multiple logics into one physical logic. Similarly, where a single logic is described, it may be possible to distribute that single logic between multiple physical logics.

Furthermore, the logic(s) presented herein for accomplishing various methods of this system may be directed towards improvements in existing computer-centric or internet-centric technology that may not have previous analog versions. The logic(s) may provide specific functionality directly related to structure that addresses and resolves some problems identified herein. The logic(s) may also provide significantly more advantages to solve these problems by providing an exemplary inventive concept as specific logic structure and concordant functionality of the method and system. Furthermore, the logic(s) may also provide specific computer implemented rules that improve on existing technological processes. The logic(s) provided herein extends beyond merely gathering data, analyzing the information, and displaying the results. Further, portions or all of the present disclosure may rely on underlying equations that are derived from the specific arrangement of the equipment or components as recited herein. Thus, portions of the present disclosure as it relates to the specific arrangement of the components are not directed to abstract ideas. Furthermore, the present disclosure and the appended claims present teachings that involve more than performance of well-understood, routine, and conventional activities previously known to the industry. In some of the method or process of the present disclosure, which may incorporate some aspects of natural phenomenon, the process or method steps are additional features that are new and useful.

The articles "a" and "an," as used herein in the specification and in the claims, unless clearly indicated to the contrary, should be understood to mean "at least one." The phrase "and/or," as used herein in the specification and in the claims (if at all), should be understood to mean "either or both" of the elements so conjoined, i.e., elements that are conjunctively present in some cases and disjunctively present in other cases. Multiple elements listed with "and/or" should be construed in the same fashion, i.e., "one or more" of the elements so conjoined. Other elements may optionally be present other than the elements specifically identified by the "and/or" clause, whether related or unrelated to those elements specifically identified. Thus, as a non-limiting example, a reference to "A and/or B", when used in conjunction with open-ended language such as "comprising" can refer, in one embodiment, to A only (optionally including elements other than B); in another embodiment, to B only (optionally including elements other than A); in yet another embodiment, to both A and B (optionally including other elements); etc. As used herein in the specification and in the claims, "or" should be understood to have the same meaning as "and/or" as defined above. For example, when separating items in a list, "or" or "and/or" shall be interpreted as being inclusive, i.e., the inclusion of at least one, but also including more than one, of a number or list of elements, and, optionally, additional unlisted items. Only terms clearly indicated to the contrary, such as "only one of" or "exactly one of," or, when used in the claims, "consisting of," will refer to the inclusion of exactly one element of a number or list of elements. In general, the term "or" as used herein shall only be interpreted as indicating exclusive alternatives (i.e. "one or the other but not both") when preceded by terms of exclusivity, such as "either," "one of," "only one of," or "exactly one of." "Consisting essentially of," when used in the claims, shall have its ordinary meaning as used in the field of patent law.

As used herein in the specification and in the claims, the phrase "at least one," in reference to a list of one or more elements, should be understood to mean at least one element selected from any one or more of the elements in the list of elements, but not necessarily including at least one of each and every element specifically listed within the list of elements and not excluding any combinations of elements in the list of elements. This definition also allows that elements may optionally be present other than the elements specifically identified within the list of elements to which the phrase "at least one" refers, whether related or unrelated to those elements specifically identified. Thus, as a non-limiting example, "at least one of A and B" (or, equivalently, "at least one of A or B," or, equivalently "at least one of A and/or B") can refer, in one embodiment, to at least one, optionally including more than one, A, with no B present (and optionally including elements other than B); in another embodiment, to at least one, optionally including more than one, B, with no A present (and optionally including elements other than A); in yet another embodiment, to at least one, optionally including more than one, A, and at least one, optionally including more than one, B (and optionally including other elements); etc.

While components of the present disclosure are described herein in relation to each other, it is possible for one of the components disclosed herein to include inventive subject matter, if claimed alone or used alone. In keeping with the above example, if the disclosed embodiments teach the features of components A and B, then there may be inventive subject matter in the combination of A and B, A alone, or B alone, unless otherwise stated herein.

As used herein in the specification and in the claims, the term "effecting" or a phrase or claim element beginning with the term "effecting" should be understood to mean to cause something to happen or to bring something about. For example, effecting an event to occur may be caused by actions of a first party even though a second party actually performed the event or had the event occur to the second party. Stated otherwise, effecting refers to one party giving another party the tools, objects, or resources to cause an event to occur. Thus, in this example a claim element of "effecting an event to occur" would mean that a first party is giving a second party the tools or resources needed for the second party to perform the event, however the affirmative single action is the responsibility of the first party to provide the tools or resources to cause said event to occur.

When a feature or element is herein referred to as being "on" another feature or element, it can be directly on the other feature or element or intervening features and/or elements may also be present. In contrast, when a feature or element is referred to as being "directly on" another feature or element, there are no intervening features or elements present. It will also be understood that, when a feature or element is referred to as being "connected", "attached" or "coupled" to another feature or element, it can be directly connected, attached or coupled to the other feature or element or intervening features or elements may be present. In contrast, when a feature or element is referred to as being "directly connected", "directly attached" or "directly coupled" to another feature or element, there are no intervening features or elements present. Although described or shown with respect to one embodiment, the features and elements so described or shown can apply to other embodiments. It will also be appreciated by those of skill in the art that references to a structure or feature that is disposed "adjacent" another feature may have portions that overlap or underlie the adjacent feature.

Spatially relative terms, such as "under", "below", "lower", "over", "upper", "above", "behind", "in front of", and the like, may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if a device in the figures is inverted, elements described as "under" or "beneath" other elements or features would then be oriented "over" the other elements or features. Thus, the exemplary term "under" can encompass both an orientation of over and under. The device may be otherwise oriented (rotated 90 degrees or at other orientations) and the spatially relative descriptors used herein interpreted accordingly. Similarly, the terms "upwardly", "downwardly", "vertical", "horizontal", "lateral", "transverse", "longitudinal", and the like are used herein for the purpose of explanation only unless specifically indicated otherwise.

Although the terms "first" and "second" may be used herein to describe various features/elements, these features/elements should not be limited by these terms, unless the context indicates otherwise. These terms may be used to distinguish one feature/element from another feature/element. Thus, a first feature/element discussed herein could be termed a second feature/element, and similarly, a second feature/element discussed herein could be termed a first feature/element without departing from the teachings of the present invention.

An embodiment is an implementation or example of the present disclosure. Reference in the specification to "an embodiment," "one embodiment," "some embodiments," "one particular embodiment," "an exemplary embodiment," or "other embodiments," or the like, means that a particular feature, structure, or characteristic described in connection with the embodiments is included in at least some embodiments, but not necessarily all embodiments, of the invention. The various appearances "an embodiment," "one embodiment," "some embodiments," "one particular embodiment," "an exemplary embodiment," or "other embodiments," or the like, are not necessarily all referring to the same embodiments.

If this specification states a component, feature, structure, or characteristic "may", "might", or "could" be included, that particular component, feature, structure, or characteristic is not required to be included. If the specification or claim refers to "a" or "an" element, that does not mean there is only one of the element. If the specification or claims refer to "an additional" element, that does not preclude there being more than one of the additional element.

As used herein in the specification and claims, including as used in the examples and unless otherwise expressly specified, all numbers may be read as if prefaced by the word "about" or "approximately," even if the term does not expressly appear. The phrase "about" or "approximately" may be used when describing magnitude and/or position to indicate that the value and/or position described is within a reasonable expected range of values and/or positions. For example, a numeric value may have a value that is +/−0.1% of the stated value (or range of values), +/−1% of the stated value (or range of values), +/−2% of the stated value (or range of values), +/−5% of the stated value (or range of values), +/−10% of the stated value (or range of values), etc. Any numerical range recited herein is intended to include all sub-ranges subsumed therein.

Additionally, the method of performing the present disclosure may occur in a sequence different than those described herein. Accordingly, no sequence of the method should be read as a limitation unless explicitly stated. It is recognizable that performing some of the steps of the method in a different order could achieve a similar result.

In the claims, as well as in the specification above, all transitional phrases such as "comprising," "including," "carrying," "having," "containing," "involving," "holding," "composed of," and the like are to be understood to be open-ended, i.e., to mean including but not limited to. Only the transitional phrases "consisting of" and "consisting essentially of" shall be closed or semi-closed transitional phrases, respectively, as set forth in the United States Patent Office Manual of Patent Examining Procedures.

To the extent that the present disclosure has utilized the term "invention" in various titles or sections of this specification, this term was included as required by the formatting requirements of word document submissions pursuant the guidelines/requirements of the United States Patent and Trademark Office and shall not, in any manner, be considered a disavowal of any subject matter.

In the foregoing description, certain terms have been used for brevity, clearness, and understanding. No unnecessary limitations are to be implied therefrom beyond the requirement of the prior art because such terms are used for descriptive purposes and are intended to be broadly construed.

Moreover, the description and illustration of various embodiments of the disclosure are examples and the disclosure is not limited to the exact details shown or described.

What is claimed is:

1. A smart store communication interface (SSCI) squib of a countermeasure expendable, comprising:

a first electrical network;

a second electrical network isolated from the first electrical network; and a fire pin contact operably engaged with the first electrical network and the second electrical network;

wherein the SSCI squib is configured to one of ignite a propellant loaded inside of a housing of the SSCI squib and communicate with a processor of the countermeasure expendable in response to receiving at least one electrical signal at the fire pin contact.

2. The SSCI squib of claim 1, wherein the first electrical network is configured to ignite the propellant loaded inside of the housing in response to receiving the at least one electrical signal at a first voltage at the fire pin contact; and wherein the second electrical network is configured to communicate with the processor of the countermeasure expendable in response to receiving at least another electrical signal at a second voltage at the fire pin contact that is less than the first voltage of the at least one electrical signal.

3. The SSCI squib of claim 1, further comprising:

an annular conductor of a support member operably engaged with the housing; and an insulated seal of the support member operably engaged inside of the annular conductor;

wherein the insulated seal is configured to electrically isolate the first electrical network and the second electrical network from one another.

4. The SSCI squib of claim 3, wherein the insulated seal comprises:

a top end;

a bottom end vertically opposite to the top end;

a first opening defined between the top end and the bottom end for enabling a conductor pin of the first electrical network to operably engaged with the insulated seal; and a second opening defined between the top end and the bottom end for enabling a conduit of the support member to operably engaged with the insulated seal.

5. The SSCI squib of claim 3, wherein the first electrical network comprises:

a conductor pin operably engaged with the fire pin contact;

a bridge wire operably engaged with the conductor pin; and a Zener diode operably engaged with and axially aligned with the fire pin contact and the conductor pin and defining a predetermined voltage threshold.

6. The SSCI squib of claim 5, wherein the second electrical network comprises:

a communication wire operably engaged with the fire pin contact and electrically isolated from the conductor pin and the bridge wire.

7. The SSCI squib of claim 6, wherein when an electrical signal includes a voltage that is greater than the predetermined voltage threshold of the Zener diode, the electrical signal passes through the Zener diode to the conductor pin and the bridge wire.

8. The SSCI squib of claim 6, wherein when an electrical signal includes a voltage that is less than the predetermined voltage threshold of the Zener diode, the electrical signal passes through the communication wire and communicates with the processor of the countermeasure expendable.

9. The SSCI squib of claim 6, wherein the support member further comprises:

a conduit operably engaged with the insulated seal;

wherein the conduit houses a portion of the communication wire to electrically isolate the communication wire from the conductor pin and the bridge wire inside of the support member.

10. The SSCI squib of claim 6, wherein the second electrical network further comprises:

an annular interface operably engaged with the communication wire and positioned external to a main passageway defined in the housing;

wherein the annular interface contacts a first electrical connector of a set of electrical connectors of an impulse cartridge cup to enable communication between the SSCI squib and the processor of the countermeasure expendable.

11. The SSCI squib of claim 10, wherein the annular conductor comprises:

an outer conductive surface operably engaged with an interior surface of the housing inside of the main passageway; and an inner conductive surface operably engaged with the insulated seal and facing away from the outer surface;

wherein the outer surface of the annular conductor and the interior surface complete an electrical circuit between the first electrical network and the housing.

12. The SSCI squib of claim 11, wherein the housing further comprises:

an exterior wall; and an interior wall facing opposite to the exterior wall and defining the main passageway;

wherein the interior wall operably engages with the outer conductive surface of the annular conductor;

wherein the exterior wall contacts a second electrical connector and a third electrical connector of the set of electrical connectors of the impulse cartridge cup to transmit electrical power to a payload of the countermeasure expendable.

13. The SSCI squib of claim 1, further comprising:

an insulator operably engaged with the fire pin contact, the first electrical network, and the second electrical network;

wherein the insulator is configured to direct an electrical signal between the first electrical network and the second electrical network when received at the fire pin contact.

14. The SSCI squib of claim 1, further comprising:

an electronic circuit board operably engaged with the fire pin contact; and at least one transient voltage suppressor (TVS) operably engaged with the electronic circuit board;

wherein the at least one TVS is configured to suppress at least one transient received at the fire pin contact.

15. A method, comprising:

providing a canister adapted to retain a countermeasure payload therein, wherein the canister has a first end and a second end, wherein the countermeasure payload is to be configured to deployed from the first end;

providing a smart store communication interface (SSCI) squib of a countermeasure expendable, the SSCI squib comprises:

a first electrical network;

a second electrical network isolated from the first electrical network; and a fire pin contact operably engaged with the first electrical network and the second electrical network;

effecting the SSCI squib to loaded into an impulse cartridge (IC) cup at the second end of the canister; and performing one of the following steps in response to receiving at least one electrical signal at the fire pin contact:

effecting the first electrical network to ignite a propellant of the SSCI squib; or effecting the second electrical network to communicate with a processor of the countermeasure expendable.

16. The method of claim 15, wherein the step of effecting the SSCI squib to loaded into the IC cup further comprises:

effecting an annular interface of the SSCI squib to a first electrical connector of a set of electrical connectors of the IC cup; and communicating with the processor of the countermeasure payload via the first electrical connector.

17. The method of claim 16, wherein the step of effecting the second electrical network to communicate with the processor of the countermeasure expendable further comprises:

effecting the at least one electrical signal having a first voltage to be sent to the fire pin contact;

outputting the at least one electrical signal from the fire pin contact to a Zener diode of the first electrical network; and sending the at least one electrical signal to a communication wire of the second electrical network, wherein the first voltage of the at least one electrical signal is less than a predetermined voltage threshold of the Zener diode.

18. The method of claim 16, wherein the step of effecting the SSCI squib to loaded into the IC cup further comprises:

effecting a housing of the SSCI squib to contact a first electrical connector of the set of electrical connectors of the IC cup;

effecting the housing of the SSCI squib to contact a second electrical connector of the set of electrical connectors of the IC cup; and enabling power of the processor of the countermeasure payload, via the first electrical connector and the second electrical connector, in response to the at least one electrical signal.

19. The method of claim 18, wherein the step of effecting the first electrical network to ignite the propellant of the SSCI squib:

effecting the at least one electrical signal having a second voltage to be sent to the fire pin contact;

outputting the at least one electrical signal from the fire pin contact to a Zener diode of the first electrical network; and outputting the at least one electrical signal from the Zener diode to a bridge wire of the first electrical network, wherein the second voltage of the at least one electrical signal is greater than a predetermined voltage threshold of the Zener diode.

20. The method of claim 14, further comprising:

suppressing at least one transient, via at least one transient voltage suppressor, at the fire pin contact.

* * * * *